US010350473B2

(12) United States Patent
Cŭpa

(10) Patent No.: US 10,350,473 B2
(45) Date of Patent: Jul. 16, 2019

(54) INTEGRATED MULTI-PURPOSE HOCKEY SKATEMILL AND ITS CONTROL/MANAGEMENT IN THE INDIVIDUAL TRAINING AND TESTING OF THE SKATING AND HOCKEY SKILLS

(71) Applicant: Pavol Cŭpa, Stupava (SK)

(72) Inventor: Pavol Cŭpa, Stupava (SK)

(73) Assignee: HDTS, a.s., Stupava (SK)

( * ) Notice: Subject to any disclaimer, the term of this patent is extended or adjusted under 35 U.S.C. 154(b) by 70 days.

(21) Appl. No.: 15/596,090

(22) Filed: May 16, 2017

(65) Prior Publication Data

US 2018/0001173 A1 Jan. 4, 2018

(51) Int. Cl.

| | |
|---|---|
| ***A63B 69/00*** | (2006.01) |
| ***A63B 24/00*** | (2006.01) |
| ***A63B 63/00*** | (2006.01) |
| ***A63B 69/40*** | (2006.01) |
| ***A63B 71/00*** | (2006.01) |
| ***A63B 71/06*** | (2006.01) |
| *A63B 102/24* | (2015.01) |
| *A63B 67/14* | (2006.01) |

(52) U.S. Cl.

CPC ..... *A63B 69/0026* (2013.01); *A63B 24/0062* (2013.01); *A63B 24/0075* (2013.01); *A63B 24/0084* (2013.01); *A63B 24/0087* (2013.01); *A63B 63/004* (2013.01); *A63B 69/40* (2013.01); *A63B 71/0054* (2013.01); *A63B 71/0622* (2013.01); *A63B 67/14* (2013.01); *A63B 69/0053* (2013.01); *A63B 2071/0638* (2013.01); *A63B 2071/0694* (2013.01); *A63B 2102/24* (2015.10); *A63B 2207/02* (2013.01); *A63B 2220/10* (2013.01); *A63B 2220/51* (2013.01); *A63B 2220/62* (2013.01); *A63B 2220/806* (2013.01); *A63B 2220/808* (2013.01); *A63B 2220/833* (2013.01); *A63B 2220/836* (2013.01)

(58) Field of Classification Search

CPC ..... A63B 69/0026; A63B 2102/24; A63B 24/0062

See application file for complete search history.

(56) References Cited

U.S. PATENT DOCUMENTS 5,385,520 A * 1/1995 Lepine ..... A63B 22/0023 482/51
6,837,830 B2 * 1/2005 Eldridge ..... A63B 21/157 482/54
7,780,573 B1 * 8/2010 Carmein ..... A63B 22/0242 482/4

(Continued)

FOREIGN PATENT DOCUMENTS

CA 2672558 A1 * 6/2010 ..... A63B 22/02

*Primary Examiner* — William H McCulloch, Jr.
*Assistant Examiner* — Chase E Leichliter
(74) *Attorney, Agent, or Firm* — Inventa Capital PLC

(57) ABSTRACT

An integrated multi-purpose hockey skatemill with a movable skatemill belt (2) comprising a stationary area of the artificial ice (1) with a front face of the work area wherein a movable skatemill belt (2) is built in by means of barrier-free transition areas with a system of spaced signalization/display elements (5) hung on the tiltable/sliding brackets (5*a*) at the frontal and lateral sectors with respect to the center of the movable skatemill belt (2). There is a safety restraint system (3) and a stabilization system (4) anchored above the movable skatemill belt (2).

11 Claims, 18 Drawing Sheets

(56) References Cited

U.S. PATENT DOCUMENTS

| | | | | |
|---|---|---|---|---|
| 2005/0124425 | A1* | 6/2005 | Talafous | A63B 69/0022 472/89 |
| 2006/0189453 | A1* | 8/2006 | Leblond | A62B 35/0087 482/69 |
| 2007/0054781 | A1* | 3/2007 | Blaylock | A63B 22/02 482/54 |
| 2007/0117687 | A1* | 5/2007 | Larson | A63B 22/203 482/70 |
| 2009/0176630 | A1* | 7/2009 | Larson | A63B 22/203 482/68 |
| 2014/0272848 | A1* | 9/2014 | Clarke | B29D 23/00 434/236 |
| 2016/0332026 | A1* | 11/2016 | Hiroura | G06F 19/3481 |
| 2017/0252623 | A1* | 9/2017 | Sharifi | A63B 69/0022 |

* cited by examiner

INTEGRATED MULTI-PURPOSE HOCKEY SKATEMILL AND ITS CONTROL/MANAGEMENT IN THE INDIVIDUAL TRAINING AND TESTING OF THE SKATING AND HOCKEY SKILLS

TECHNICAL FIELD OF INVENTION

The invention relates to an integrated multi-purpose hockey skatemill with a movable skatemill belt whose direction and speed may be controlled. The invention is equipped with safety, stabilization, signalization and display elements, optical scanning cameras and puck feeders. It is also equipped with a system that can measure tensile or compressive forces exerted by a skater or a hockey player. The skatemill is designed to practise skating skills or skating and shooting skills of a hockey player on the synthetic ice by means of the LightShot and LightWatch trainings as well as the Exercise Pattern and LiveView training methods, and to test performance of a hockey player through the Skating Position, Skating Power, Power Skating Analysis, Power Skating Max and $VO_{2max}$ on Skatemill tests.

BACKGROUND OF THE INVENTION

Currently, hockey players practise the skating and shooting skills mainly on a nonmoving ice surface where it is a skater or rather a hockey player who moves on the ice, i.e. a skater or a hockey player changes his position and speed relative to the reference point connected with the ice surface. What is disadvantageous about this method is that it is rather difficult or even impossible to measure decisive biomechanical parameters of the skating technique performed by a skater or a hockey player that are important to identify opportunities to improve the skating technique of a hockey player.

Equally, under such conditions it is rather difficult to measure precisely a hockey player's preparedness in relation to the monitoring and evaluation of the determined visual signals that are important in order to identify opportunities to improve and practise the shooting skills of a hockey player.

There are several ice hockey treadmills/skatemills on the market that focus on the needs of the skating skills training based on a "treadmill" belt that is adapted for the purposes of a skating training, such as treadmills made by Woodway, Blazin Thunder Sports, xHockeyProducts, Skating Trademill, Pro Flight Sports, Skate Trek, Benicky System and RapidShot. These skatemills use surfaces of the so-called endless belts that are covered by slats made of PVC or the so-called artificial ice, i.e. from materials based on a high-density polyethylene that enable a hockey player to perform skating techniques on the working part of the belt without changing his/her position relative to the stationary parts of the skatemill or the static environment of the skatemill. The skatemills of the aforementioned manufacturers are typical representatives of the so-called island solutions that are designed solely for the skating techniques practice and, occasionally, for their testing, too. The island solution refers to a solution that uses an isolated skatemill without an integrated stationary area of the synthetic ice or without a barrier-free connection to the adjacent stationary synthetic ice area and which is not functionally integrated with other systems designed for training and measurement of the skating and hockey skills as well as for the measurement of the physical performance of skaters and hockey players. Because of this, these skatemills do not offer any realistic opportunities to practise shooting, nor do they make it possible to carry out other exercises focused on honing hockey skills—on practice and development of a hockey player's ability to react to visual stimuli (which are typical in a sport like hockey) and development of a hockey player's peripheral vision. Equally, these skatemills do not enable skaters, nor hockey players, to measure their physical performance. Another downside of the aforementioned skatemills is the fact that they are not suitable for the training of beginners or less able skaters as they are not equipped, in most cases, with adequate stabilization and restraint systems providing support and facilitating movement of the beginners on the movable part of the skatemill as well as their safety in the event of their complete loss of balance resulting in a fall.

State of the art is documented in the U.S. Pat. No. 5,385,520 where we completely describe the principle of the skatemill belt with a base support and a longitudinally tilting skating deck whose positive or negative incline may be adjusted by a lifting device using two threaded rods with an electric drive. The skating deck consists of a frame fitted with the drive and idler rollers running the endless belt with artificial ice surface slats in addition to the belt support rollers and an electric motor with electric switch including a drive inverter and other necessary electrical components with a control panel including indicators of speed and belt incline as well as control features such as Start, Stop, Incline etc. Used in the construction are: a rubber belt with the polyester core, contact strips made from the so-called hardened polyethylene fixed to the belt, dovetail mounts connecting the strips to the belt and a cross handle on the front side of the skating area.

In the state of the art is also known the patent CA2672558C which describes the basic principle of the skatemill belt with a single-axis longitudinal tilting with a platform adjacent to the front side of the belt. This construction consists of a base support, a load-bearing frame of the endless belt defining the skating area, a motor connected to the belt drive, a pivotal connection of the belt-bearing frame with the base support that allows tilting of the longitudinal skating area around the axis of the front roller and connecting the stationary platform to the front of the skating platform.

Furthermore, in the state of art is also the U.S. Pat. No. 5,509,652, which describes a hockey practice alley without a moveable belt for practicing shooting skills at the goal structure. The surface of the hockey practice alley is made of artificial ice, the material whose friction properties are similar to those of natural ice. As the goal structure may be rotatably mounted on the shooting surface for simulating a variety of angle shots, the hockey player may select a stationary position on the platform.

Another patent in the state of art is U.S. Pat. No. 5,498,000, which describes a technical solution for a goaltender simulator system without a moveable belt designed to practice shooting on a hockey goal. This system simulates behaviour of a live goaltender in such a way that the trajectory of a puck launched by a player toward the goal is tracked by a camera and based on the detected positions of the puck, a computer control predicts the trajectory of the puck and a place where it is anticipated to enter the goal and moves the goaltender figure to the appropriate position to prevent it from entering the goal. The shooting surface of the simulator where the practice takes place, i.e. from where the hockey player shoots pucks is made of artificial ice, the material whose friction properties are similar to those of natural ice.

In the state of art of the U.S. Pat. No. 3,765,675 may be found a description of other, simplified technical solution for a simulated hockey goalie without a moveable skatemill belt that is designed to practice shooting on a goal. In this case, the simulated hockey goalie does not use a system for the puck trajectory prediction but rather a simple cyclical move across the mouth of a hockey goal from one side to the other. Like in the previous cases, the shooting alley surface of the simulator is made of artificial ice, the material whose friction properties are similar to those of natural ice.

Marginally, the issue is addressed in the treadmill walking as described in the published application WO2012/016131A1 which describes the applied principle of biaxial tilting of the belt. The technical solution comprises a walking belt tiltable in two axes which allows to walk in any direction without the need to leave a relatively small area of the walking surface, i.e. the surface of the belt may move in any direction. The suspension system is merely to simulate the gravitational force and dynamic impulses disrupting the walker's stability but not to provide any safety feature.

Similarly, the issue is dealt with only marginally in the case of a simulator for a stick handling practice as described in the published application WO 2008/151418 A1 with the use of optical monitoring system.

Another marginal solution to the issue is a simulator designed to practice a training method intended mainly for players of collective sports in which the so-called permitted field is dynamically delimited by controlled illumination, in which an athlete nor his gear are allowed to leave a given area, as described in the published application RU 2490045 C1. The training field is monitored by means of an infrared camera and a method of comparing video footage recognized by the computer to the permitted area is used to evaluate and signal when the athlete leaves the specific area.

Marginally and in the scope limited to technical solutions of hockey shooting simulators, i.e. the simulators that do not feature moveable skatemill belts nor stationary platforms covered by artificial ice, are such solutions described in the following patents:

U.S. Pat. No. 5,776,019 describes a goalkeeping apparatus designed to practice shooting on a hockey goal. This apparatus does not include a skatemill belt, nor a solid surface made of artificial ice, but a blocking element, a movable figure of a goaltender in standard position, that is moved by the control system of the simulator from side to side and simultaneously or independently of the translational motion positioning the figure around the vertical axis in both directions.

U.S. Pat. No. 5,509,650 describes an apparatus for improving the scoring skills in sports such as hockey, field hockey, futsal, handball, lacrosse etc. The apparatus does not include a skate mill belt, nor a stationary surface made of artificial ice but a goal with a non-moving goalkeeper figure in the standard position. Based on the current position of a player, the control system of the apparatus dynamically marks some of the target places in the open areas as a current target for which the player should aim in a predetermined time and the system evaluates the shooting percentage of the player.

U.S. Pat. No. 4,607,842 describes an apparatus for use by hockey players to practice their slap and wrist-shots on a goal. The apparatus does not include a skatemill belt and by means of light signals generated by lamps in each of the goal's corners it visually indicates to the players which target they must try to aim at. The apparatus comprises an endless belt that transports the pucks shot at the goal back to the player and automatically dispenses them to him/her. The surface of the elevated platform between the player's position and the goal which is covered by the belt for the return transport of pucks is made of a material with properties similar to those of natural ice.

Because of the aforementioned shortcomings in the existing training platforms consisting of either stationary ice surface or an isolated movable belt covered with artificial ice but without a functional integration and lacking possibilities to test skating and hockey skills, an idea for an integrated multi-purpose hockey skatemill has appeared. A system that would offer an individual training and provide skating and hockey tests on the skatemill belt with safety, stabilization, signalization and display features, optical scanning cameras, puck feeders, a system for measuring tensile and compressive forces exerted by skaters or hockey players, a control computing hardware tool such as a computer designed for individual training and skating and hockey skills tests, as the one which is described in the submitted invention.

SUMMARY OF THE INVENTION

The said deficiencies are to a great deal dealt with by means of an integrated multi-purpose hockey skatemill and the way it is controlled/used for the individual training and testing of a skater's or hockey player's skating and hockey skills. The summary of an integrated multi-purpose hockey skatemill is to achieve a continuous surface formed by a barrier-free artificial ice, that functions as a "working area" with a general ground plan comprising two or more functionally integrated planar regions, i.e. one stationary region of artificial ice and one or more regions of movable artificial ice, with a possibility to configure the spatial area as "a barrier-free training zone" defined by the height level of 2.20±0.1 m above the working surface area that may be used by a skater or hockey player to practice their skating techniques. In addition to this, the invention makes it possible to use optical signalization/display functions intended mainly to measure and practice reactions of a hockey player to visual stimuli as well as to manage workouts and practice performed by a skater or a hockey player using a puck feeder that enables the player to realistically practice shooting technique. Moreover the invention uses the system of optical sensing cameras that may scan the skater or the hockey player from the front and sideways as they perform an exercise on the movable skatemill belt and it may also take advantage of measuring tensile/compressive forces exerted by skaters or hockey players when performing "Stride Power", "Wingate", "Skating PowerTest" or other tests concerning their physical performance measurements or physiological parameters.

The shape and dimensions of the working area ground plan for the integrated multi-purpose hockey skatemill are not determined by any limitations—the working area ground plan for the integrated multi-purpose hockey skatemill may be assembled from any combination of basic geometric shapes such as square, rectangle, rhombus/parallelogram, triangle, circle, ellipse and/or their parts.

The work surface of the integrated multi-purpose hockey skatemill is entirely barrier-free and planar, i.e. without deflections or ripples of any parts of the work surface—planar surfaces of the movable or even more than one movable areas and that of the stationary artificial ice are vertically balanced to each other and their common surface plane is not disrupted by any component between the movable part(s) and the stationary part of the artificial ice. Each movable area of the artificial ice is completely, i.e. from all sides surrounded by the stationary area of the artificial ice, which allows for all the parts of the work surface to be functionally integrated into a single whole to be used for skating and/or hockey practice.

The above solution of the work surface, as the only one from all known skatemill solutions, makes it possible to practice and test ice hockey skills in realistic conditions—i.e. the conditions in which a hockey player in training is exposed to a genuine physical burden generated by means of the movable area of the skatemill belt fitted with artificial ice, while stickhandling takes place without a relative puck motion to the reference point, which helps to capture and then precisely evaluate the player's stickhandling, including the shooting skills. Functional integration, i.e. smooth and barrier-free binding of the movable and stationary parts of the artificial ice, is in this case a prerequisite for creating right conditions for a realistic hockey player's training on the artificial ice surface.

It is possible to configure the barrier-free training zone on the integrated multi-purpose hockey skatemill by tilting or extending the stabilization system construction and the brackets bearing optical signalization and display devices and sensors to measure the forces vertically upwards, above the height level of 2.2±0.1 m or horizontally outside the ground plan of the work surface clearing the space above for the needs of skating and/or shooting practice.

The movable part of the artificial ice, i.e. the variable part of the work surface, comprises the so-called endless belt whose external surface is fitted with artificial ice, hence "skatemill" belt. The skatemill belt with the said construction rests on two load-bearing rotating drums that are fixed to the common base support through ball bearings. At least one of the load-bearing drums is powered by an electric motor drive.

The area of the skatemill belt, whose surface is part of the working area, may perform straightforward sliding movement both ways. The skatemill belt is in this section propped up by solid beams with the stationary sliding surfaces at the point of contact with the skatemill belt whose longer dimensions of the beams are oriented in the direction of the skatemill belt's movement.

The said support of the skatemill belt by means of solid load-bearing construction makes sure that the firmness of the movable part of artificial ice is identical to the firmness of the stationary part of the ice surface and in fact it is not much different than the firmness of the actual ice surface which contributes to authenticity of the skating or hockey practice on this hockey skatemill.

The skatemill belt is powered by a three-phase asynchronous electric motor. Continuous regulation of the direction and the speed of the electric motor is carried out by a frequency converter controlled by a computational hardware tool. The direction and the speed of the skatemill may be run continuously or incrementally by 0.5 km/h from 1 km/h up to the maximum design speed of the skatemill.

The direction and the speed of the skatemill belt is controlled by the Electronic Control Block (ECB) which allows automated implementation of training and testing performed on the integrated multi-purpose hockey skatemill. ECB also serves as a controller for the operator of the skatemill, i.e. to switch the skatemill ON/OFF and to change the direction and the speed of the skatemill belt. By the automated implementation of training or testing one means a physical control and time coordination of the controllable functions of the skatemill related to the motion of the skatemill belt.

Restraint system protects the skater or hockey player from falling on the moving skatemill belt when losing their footing. The restraint system comprises a personal harness system, e.g. a full body fall protection harness with a dorsal D-ring and adjustable straps connected via carabiner clips on one side to the skater's full body harness and on the other to the anchoring point attached to a safety switch that will stop the skatemill belt from moving if pulled by the weight of the skater.

Above the skatemill belt there is a skater's/hockey player's stabilization system consisting of two top-hung vertical beams with the foldable horizontal handrails whose position, i.e. the height from the work surface may be set up according to the physical proportions or needs of a skater. The handrails may be tipped into an upright position, i.e. in parallel with the vertical beams, thus freeing the space of the movable part of artificial ice in order to perform skating exercises.

The vertical beams are hung in places over the side of the movable and stationary lines of the work surface so that the beams with unfolded handrails do not interfere with the space above the skatemill belt.

Optical signalization/display features comprise display units, i.e. lights, point, segment and/or flat imaging displays that are fitted on the tilting or openable and height-adjustable brackets positioned on a semicircular line whose center is identical with the center of the skatemill belt. Control of the optical signalization/display elements is automated by means of the electronic control block (ECB) of the integrated multi-purpose skatemill.

The optical signalization/display system is intended for the LightShot and/or LightWatch trainings that focus on the development of a hockey player's reaction capabilities to visual stimuli during shooting practice (LightShot) and on the development of the so-called peripheral vision (LightWatch), as well as for the skaters or hockey players doing the Exercise Pattern training method. The Exercise Pattern training method is based on a visual presentation of one or more views of an exercise or practice to be performed by a skater or a hockey player on the skatemill belt just before they actually start carrying the exercise or practice out.

During the LightShot training, by means of a frequency converter, the skatemill's electronic control block (ECB) controls, i.e. sets the skatemill belt in motion in such a way that it moves by a predetermined speed. The ECB also controls the display of light and optical signals $S_1$-$S_5$ on the flat screen of the central display element in zones $Z_1$="LEFT TOP CORNER", $Z_2$="RIGHT TOP CORNER", $Z_3$="BOTTOM CENTER", $Z_4$="LEFT BOTTOM CORNER" and $Z_5$="RIGHT BOTTOM CORNER" in any given or random order. A hockey player skating on the skatemill belt responds to these light stimuli by shooting a puck to the indicated target zone defined as e.g. the frontal plane of a hockey goal structure. Should the hockey player fail to shoot in a specified period "$t_{signal}$", the application will evaluate this as a failed attempt. After the test the electronic control block (ECB) stops the movement of the skatemill belt. The total number of the signals sent by the application $N=\Sigma N_q$, q=1-5 and the number of accurate hits of the indicated target zone $n=\Sigma n_q$, q=1-5 achieved by a hockey player within the given time limit are logged automatically or non-automatically. These data represent the test results. By configuring the so-called mapping signals vector in any other way than based on the "1:1" scheme represented by the incidence of the signals and target zones: $S_1 \rightarrow Z_1$, $S_2 \rightarrow Z_2$, $S_3 \rightarrow Z_3$, $S_4 \rightarrow Z_4$ a $S_5 \rightarrow Z_5$, it is possible to configure any other incidence, i.e. to map signals S and target zones Z, e.g. $S_1 \rightarrow Z_2$, $S_2 \rightarrow Z_1$, $S_3 \rightarrow Z_3$, $S_4 \rightarrow Z_4$ a $S_5 = Z_5$, or e.g. $S_1 \rightarrow Z_4$, $S_2 \rightarrow Z_5$, $S_3 \rightarrow Z_3$, $S_4 \rightarrow Z_1$ a $S_5 \rightarrow Z_2$ etc., thus making it possible to alternate the training's level of difficulty according to the needs of a hockey player. The ECB provides automatic detection of the precise hits of the target zones through mechanical contact, piezoelectric or contactless optical or inductive sensors fitted in the target zones of a hockey goal $Z_1$-$Z_5$ placed in front of the skatemill belt on the borderline defining the front side of the work area in the extension of the longitudinal axis of the skatemill belt. Non-automated monitoring of the valid hits is carried out by the operator of the skatemill.

During the LightWatch training, the electronic control block (ECB) of the skatemill controls, i.e. sets the skatemill belt in motion by means of a frequency converter, so that it could move at the default or set speed. The ECB also controls the display of the light signals Y={0-9|00-99|aA-zZ| ■●▲} (i.e. numbers and digits, alphabetic characters and simple geometric figures) apart from the central display element, also on the display elements positioned in the LEFT zone and in the RIGHT zone of a hockey player's peripheral vision in any given time or in a random order. A hockey player who is skating on the moving skatemill belt responds to these light stimuli via identifying and verbalizing a symbol and/or doing something else, e.g. shooting at the predetermined target zone. After the test, the ECB stops the movement of the skatemill belt. The total number of the signals sent by the application $N=\Sigma N_q$, q=1-5 and the number of correctly identified symbols by a hockey player within the time limit "$t_{display}$" $n=\Sigma n_q$, q=1-5 are logged automatically or non-automatically. These data represent the test results. Automated detection of the correctly identified symbols in the case of their verbalization by a hockey player is provided by the application LightWatch using a speech recognition system. An acoustic microphone monitoring verbal messages of a hockey player is in this case placed on a protective helmet of the hockey player or on a headset holder. Alternatively, if the hockey player responds to the visualized signals by shooting at the designated zones, the automated detection of the impacts on the target zones is provided by the ECB by means of mechanical contact or piezoelectric or the contactless optical and inductive sensors fitted in the target zones of a hockey goal $Z_1$-$Z_5$ placed in front of the skatemill belt on the borderline defining the front side of the work area in the extension of the longitudinal axis of the skatemill belt. Non-automated monitoring of the valid hits is carried out by the operator of the skatemill.

During the Exercise Pattern training, on one or more display elements, the electronic control block (ECB) of the skatemill shows a recorded digital video footage "Sample( )" of the practice or exercise that a skater or a hockey player on the skatemill is supposed to carry out. After viewing the video recording of the practice or exercise, the ECB, by means of a frequency converter, controls, i.e. sets the skatemill belt in motion so that it could move at the default or set speed. After the given time "Tduration" planned to carry out the training or exercise has elapsed, the ECB stops the movement of the skatemill.

The optical scanning cameras are placed at the borders of the training area in the vertical planes passing through the longitudinal and transverse axis of the movable skatemill belt so that they allow to watch a skater or a hockey player on the movable skatemill belt from the front and side views. Control of the optical scanning cameras is automated by means of the electronic control block (ECB) of the integrated multi-purpose skatemill.

The optical scanning cameras system is intended for the Skating Position test, in which the system is used for making a video footage of the skater or hockey player performing exercises on the moving skatemill belt.

During the Skating Position training, by means of a frequency converter, the electronic control block (ECB) of the skatemill controls, i.e. sets the skatemill belt in motion so that it could move at the default or set speed. The ECB also manages the creation and storage of digital video recordings of the course of the skating performed by a skater or a hockey player on the movable skatemill belt from the front (StreamRecord1) and the side (StreamRecord2) views. After the test, i.e. after the time "$T_{PERIOD}$" has elapsed, the ECB stops the movement of the skatemill. Following that, canonical segments are added to the digital video recordings, e.g. in MPEG4 format, via video editing tools in either automated or non-automated way. The canonical segments represent positions of the lower extremities or their parts, mutual positions and kinematic movement patterns whose canonical segments are further analyzed in order to identify shortcomings and/or optimize skating skills of a skater or a hockey player.

In combination with the optical signalization/display elements system, the optical scanning cameras system is intended for the LiveView training method. The basis of the LiveView training method is a delayed visual presentation of one or more views of an exercise or training performed by a skater or a hockey player on the skatemill belt.

During the LiveView training, by means of a frequency converter, the electronic control block (ECB) of the skatemill controls, i.e. sets the skatemill belt in motion so that it could move at the default or set speed. The ECB also manages the creation and temporary storage of digital video recordings (the front "StreamRecord1" and the side "StreamRecord2") and a delayed (with a delay "Tdelay"=<5 s-15 min>) presentation of the created video recordings of a prior exercise or training performed by a skater or a hockey player. If the delay "Tdelay" is set at the same time as the duration of an exercise or a training, it is possible for the skater or the hockey player to watch his very own just finished exercise or training in order to realize their potential shortcomings committed at the training.

During the skating training, it is possible to place two removable laser markers on the stationary area of artificial ice in order to define the width of the skating "band", the so-called skating track. This aid may be used during the skating training, especially in exercises related to identifying and correcting mistakes in the glide phase.

Puck feeders used at the shooting practice are placed on the borders of the work area, i.e. they do not interfere with the work area. The puck feeders may be used in the manual mode or they may be managed automatically by means of the electronic control block (ECB) of the skatemill. The puck feeders may be used for shooting training or practice in the static mode when the hockey player does not skate, only shoots the incoming pucks or for shooting training or practice in the dynamic mode when the hockey player simultaneously shoots the incoming pucks and actively performs skating technique on the moving skatemill belt.

Alternately, during the LightShot training, the electronic control block (ECB) may control puck feeders in coordination with the course of the LightShot exercise, i.e. the incoming pucks are time-synchronized with anticipated moment of shooting from the hockey player as a response to a light navigation symbol.

The sensors for measuring the power are piezoelectric or tensiometric force measuring sensors. They are located in a vertical plane passing through the axis of the skatemill belt to the front or to the back of a skater/hockey player. They are connected to a personal harness system, e.g. full-body harness, through a rigid rod or that of a fiber type and they measure tensile or compressive forces exerted by a skater or a hockey player. These forces are the only measurable quantities indicating the physical performance of a skater or a hockey player that may be measured on the hockey skatemill. This kind of power measurement is necessary for the Skating Power, Power Skating Analysis or Power Skating Max tests that are performed on the moving skatemill belt. Measuring and recording data from the sensors to measure the forces is carried out via electronic control block (ECB) of the skatemill, with a minimum frequency of 1 kHz for the data measurement on the tensile or compressive force exerted by a skater. The result of the Power Skating Max test is a speed performance profile for a skater or a hockey player based on the speed of skating represented by the speed of the skatemill belt, as a "skating speed". In addition to that, it serves as an endurance performance profile and a fatigue index for a skater or a hockey player. It is possible to determine the speed performance profile for a skater or a hockey player through the Skating Power test alone. The endurance performance profile and the fatigue index may be also determined independently via the Power Skating Analysis test. All the said cases represent dynamic tests. It is the way how they are performed that actually makes it possible to measure and evaluate the power-speed and power-endurance capabilities of a skater and a hockey player in conditions that realistically correspond to the skating conditions.

The speed performance profile for a skater or a hockey player is laid as an 8-element sequence of the values of power (expressed in watts) exerted by a skater or a hockey player while skating on a level surface facing forward in eight different reference skating speeds, as follows: 15.0-16.5-18.0-19.5-21.0-22.5-24.0-25.5 km/h. Power given by skater is determined by the method described below.

From the measured tensile or compressive forces respectively, one measures the power attained by a skater or a hockey player in each of the eight reference skating speeds "$v_{stride}$" 15.0-16.5-18.0-19.5-21.0-22.5-24.0-25.5 km/h, by relation:

$$P = 1/8\sum_{k=1}^{8} F_k \cdot v_{stride}[W, N, \mathrm{ms}_{-1}]$$

in which "P" stands for performance exerted by a skater or a hockey player, "k" is a serial number of a skating stride in an 8-step series and "$F_k$" represents the maximum tensile or compressive forces exerted by a skater or a hockey player as measured by the sensor for measuring the force in the skating stride "k".

Between the respective tests, i.e. between the tests at the reference speeds 15.0-16.5-18.0-19.5-21.0-22.5-24.0-25.5 km/h are included relaxation intervals of not less than 120 seconds.

The Power Skating Analysis test is a version of the standard anaerobic "Wingate" test which is used to determine the maximum anaerobic power and fatigue index of a skater or a hockey player. To determine the said parameters, i.e. to determine the maximum anaerobic performance and fatigue index, one uses in the Power Skating Analysis test an endurance performance profile. It is determined as the 6-element sequence of average values of power (expressed in watts) exerted by a skater while skating on a level surface facing forward in six different time intervals, as follows: <0-5 s>, <5-10 s>, <10-15 s>, <15-20 s>, <20-25 s>, <25-30 s>. Power given by skater or hockey player is determined by the method that is based on the "Power Skating Analysis" algorithm. This test is to determine the endurance performance profile of a skater or a hockey player using the measured tensile or compressive forces F respectively through the Power Skating Analysis application. It is represented by average values of performance ($P_{[0-5]}$, $P_{[5-10]}$, $P_{[10-15]}$, $P_{[15-20]}$, $P_{[20-25]}$, $P_{[25-30]}$) in the 6-step sequence detected at a speed $v_{strideMAX}$ in time intervals: <0-5 s>, <5-10 s>, <10-15 s>, <15-20 s>, <20-25 s>, <25-30 s> by the relations:

$$P_{[0-5]} = v_{strideMAX} \cdot 1/5\int_{t=0}^{5} F_{stride}(t)dt \ [W, \mathrm{ms}_{-1}, N]$$

$$P_{[5-10]} = v_{strideMAX} \cdot 1/5\int_{t=5}^{10} F_{stride}(t)dt \ [W, \mathrm{ms}_{-1}, N]$$

$$P_{[10-15]} = v_{strideMAX} \cdot 1/5\int_{t=10}^{15} F_{stride}(t)dt \ [W, \mathrm{ms}_{-1}, N]$$

$$P_{[15-20]} = v_{strideMAX} \cdot 1/5\int_{t=15}^{20} F_{stride}(t)dt \ [W, \mathrm{ms}_{-1}, N]$$

$$P_{[20-25]} = v_{strideMAX} \cdot 1/5\int_{t=20}^{25} F_{stride}(t)dt \ [W, \mathrm{ms}_{-1}, N]$$

$$P_{[25-30]} = v_{strideMAX} \cdot 1/5\int_{t=25}^{30} F_{stride}(t)dt \ [W, \mathrm{ms}_{-1}, N]$$

in which "$P_{[\ ]}$" is average power exerted by a skater or a hockey player within the measured 5-second interval and "$F_{stride}(t)$" is a function that expresses time dependency of the tensile or compressive forces exerted by a skater or a hockey player as measured by the sensor for measuring the force in the measured 5-second interval.

Fatigue index of a skater or a hockey player is the extent (size) of the power loss exerted by a skater or a hockey player at the start, in time interval <0-5 s> and at the end, in time interval <25-30 s> of the Power Skating Analysis test. It is expressed in % of the extent of power loss and the average performance attained by a skater in the interval <0-5 s> by the relation in %:

$$\mathrm{INDEX}_U = \frac{P_{[0-5]} - P_{[25-30]}}{P_{[25-30]}} \cdot 100\% \ [\%]$$

This test refers to the ratio of fast and slow muscle fibers activation, thus indirectly on their proportional representation in the muscles of tested individuals.

The Power Skating Max test which is performed based on the "Power Skating Max" algorithm is used to determine simultaneously the speed performance profile of a skater and the endurance performance profile with fatigue index of a skater. It is calculated from the measured tensile or compressive forces $F_k$ and $F_{stride}$ at the reference skating speeds $v_{stride}$ by the Power Skating Max application.

Speed control feature of the skatemill belt of the integrated multi-purpose hockey skatemill may be used to perform the so-called $VO_{2max}$ test. The $VO_{2max}$ on Skatemill test is a version of the aerobic capabilities test, i.e. the level of maximum oxygen consumption of a skater or a hockey player as intended for the aerobic capabilities test on the integrated multi-purpose hockey skatemill. The result of the $VO_{2max}$ on Skatemill test is an aerobic performance profile recorded by an external spirometric or cardiopulmonary monitor.

During $VO_{2max}$ on Skatemill test, it is the electronic control block (ECB) of the skatemill that controls the speed of the skatemill belt through a frequency converter in autonomous or coupled mode. In the coupled mode, it is an external spirometric or cardiopulmonary monitor that controls the speed of the skatemill belt. The external spirometric or cardiopulmonary monitor is connected to the universal communication interface of the electronic control block (ECB) of the skatemill via own signal or data cable. Connection between the external spirometric or cardiopulmonary monitor and the electronic control block (ECB) is not included in the technical solution of the skatemill.

When in the autonomous mode of the $VO_{2max}$ on Skatemill test, the electronic control block (ECB) controls the movement of the skatemill belt through a frequency converter in such a way that it starts to move at a speed "$v_{START}$" and then it incrementally increases the speed of the skatemill belt in the I. speed zone by a 2 km/h stride until it reaches II. speed zone. Once in the II. speed zone, the speed incrementally increases each minute by a 1 km/h stride until the end of the test. The test itself finishes either after 1 minute of the maximum speed of the skatemill belt "$v_{skateMAX}$" or in any given moment on request of the skater or hockey player. After taking the test, the electronic control block (ECB) of the skatemill stops the movement of the skatemill belt. Result of the test is a data set recorded by an external spirometric or cardiopulmonary monitor.

The advantages of an integrated multi-purpose hockey skatemill with the method of control/management for the individual training and testing of the skating and hockey skills based on the invention are evident from its external effects. The effects of the integrated multi-purpose hockey skatemill with the method of control/management for the individual training and testing of the skating and hockey skills rest in the fact that it is a training tool that faithfully mimics skating on real ice. It is the dynamic skating mode, i.e. the mutual relative movement of a skater or a hockey player and the skating surface that is provided by a translational movement of the movable skatemill belt whose friction properties correspond with the friction conditions of the ice surface.

Furthermore, the effects of the operation of an integrated multi-purpose hockey skatemill to the method of its control/management for training and testing of the skating and hockey skills based on the invention rest in the fact that in shooting skills practice (LightShot), in peripheral vision development (LightWatch), in the Exercise Pattern training method and in skating skills test (Skating Position) and in performance tests such as Power Skating Max, or Skating Power and Power Skating Analysis, it is possible to effectively stabilize the position of a skater or a hockey player against the static elements of the optical signalization/display system and the optical scanning cameras system. The same goes for the sensors measuring tensile/compressive forces, i.e. the position of a skater or a hockey player against the stationary parts of the integrated multi-purpose hockey skatemill does not change. Due to the precise and repeatable position of a skater or a hockey player against the static parts of the hockey skatemill, such as display features, cameras and force measuring sensors and considering the possibility to precisely control the physical load of a skater or a hockey player by regulating the speed of the skatemill belt, it is possible to manage and evaluate each training and testing on the integrated multi-purpose skatemill with each repetition. This allows to improve to a great extent the way how to select from trainings based on the individual needs of skaters or hockey players and by measuring the ability of skaters or hockey players, under deterministic conditions, to evaluate the actual effectiveness of these trainings.

BRIEF DESCRIPTION OF THE DRAWINGS

The integrated assembly of a multi-purpose hockey skatemill and the method of control/management for the individual training and testing of the skating and hockey skills according to the invention will be further described in the enclosed drawings wherein.

DETAILED DESCRIPTION OF THE INVENTION

It is understood that individual examples of the implementation of the invention are presented to illustrate and not to limit. Using no more than routine experimentation, any knowledgeable professionals may find or be able to find a number of equivalents to the specification of the implementation of the invention which are not explicitly described here. Such equivalents are meant to fall within the scope of the following patent claims. Any topological or kinematic modification of this kind of hockey skatemill, including necessary design, choice of materials and design layout may not be a problem, therefore these features have not been dealt with in detail.

Example 1

Figure 1:
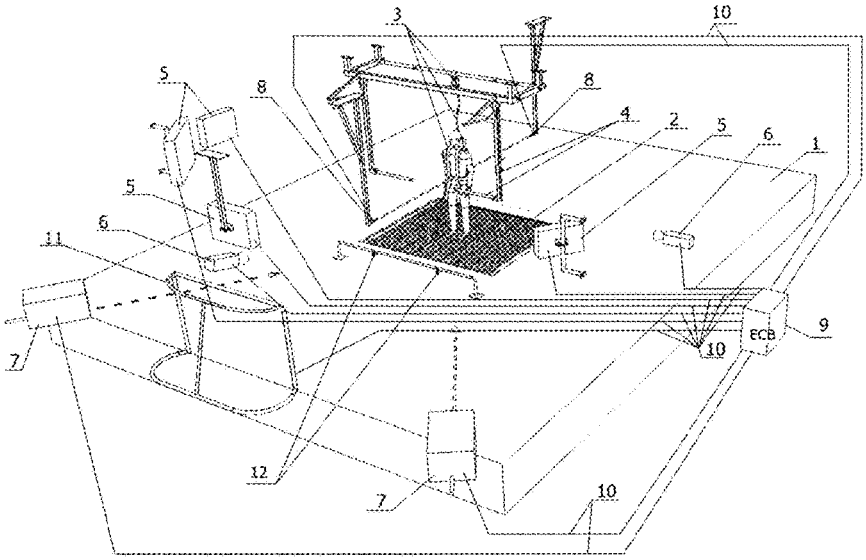
FIG. 1 represents an overall view of the basic layout of the elements of the integrated multi-purpose hockey skatemill.
Figure 3:
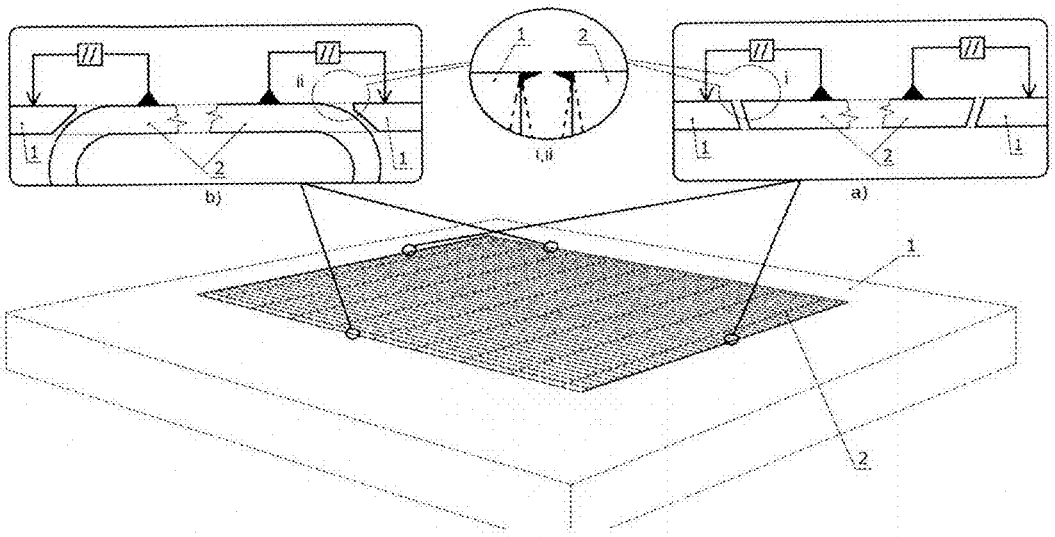
FIG. 3 presents a functional integration of the mobile and stationary parts of the working area in the case of one movable skatemill belt.
Figure 4:
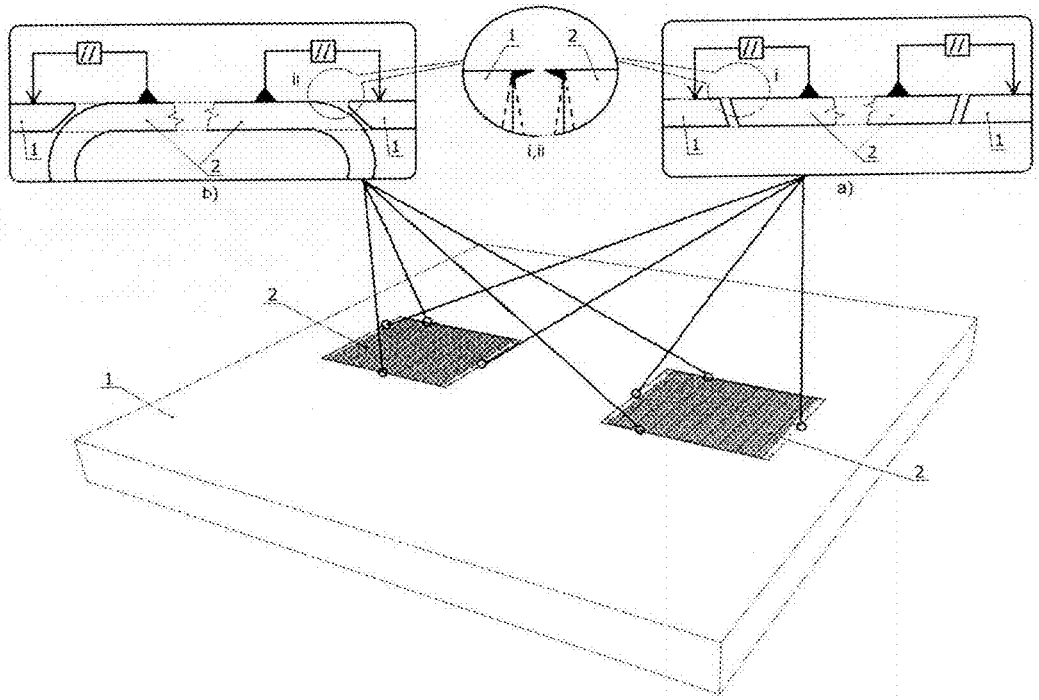
FIG. 4 describes a functional integration of the working area parts in the case of multiple movable skatemill belts.
Figure 5:
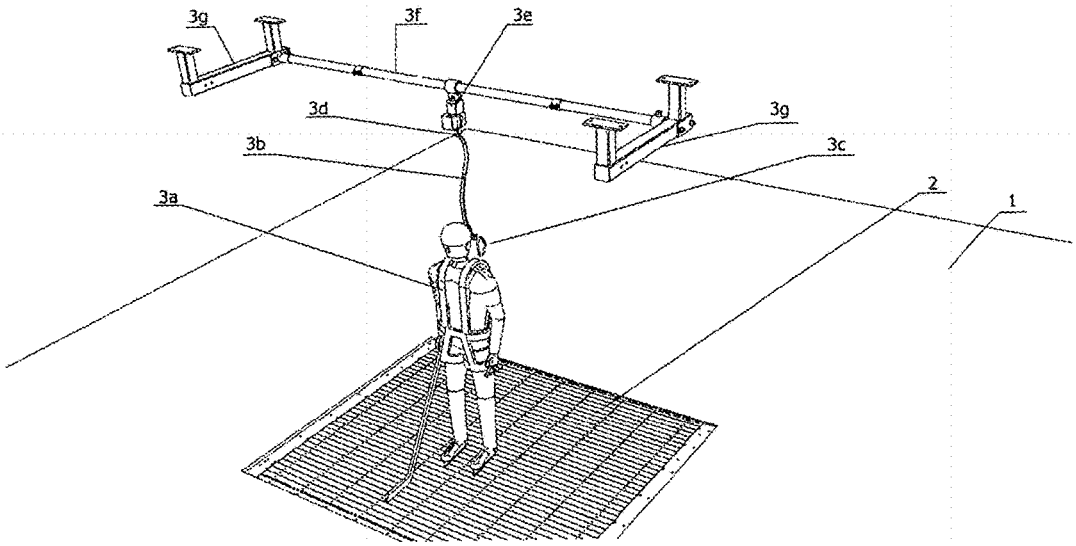
FIG. 5 shows a view of the safety restraint system for skaters or hockey players in perspective.
Figure 6:
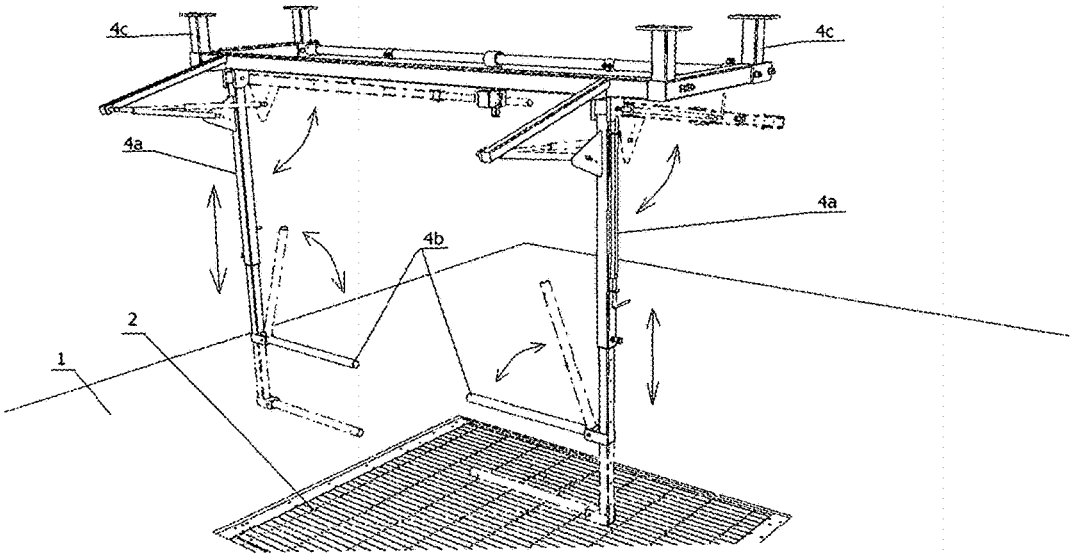
FIG. 6 shows a view of the stabilization system for skaters or hockey players.
Figure 7:
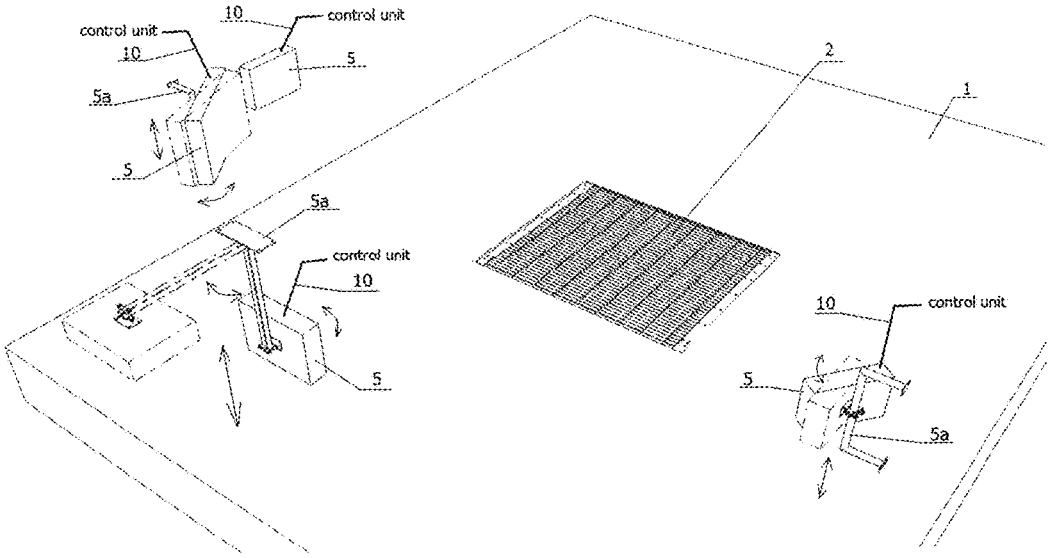
FIG. 7 gives a view of the signalization/display elements assembly hinged to the tilting and telescopic brackets in perspective.
Figure 8:
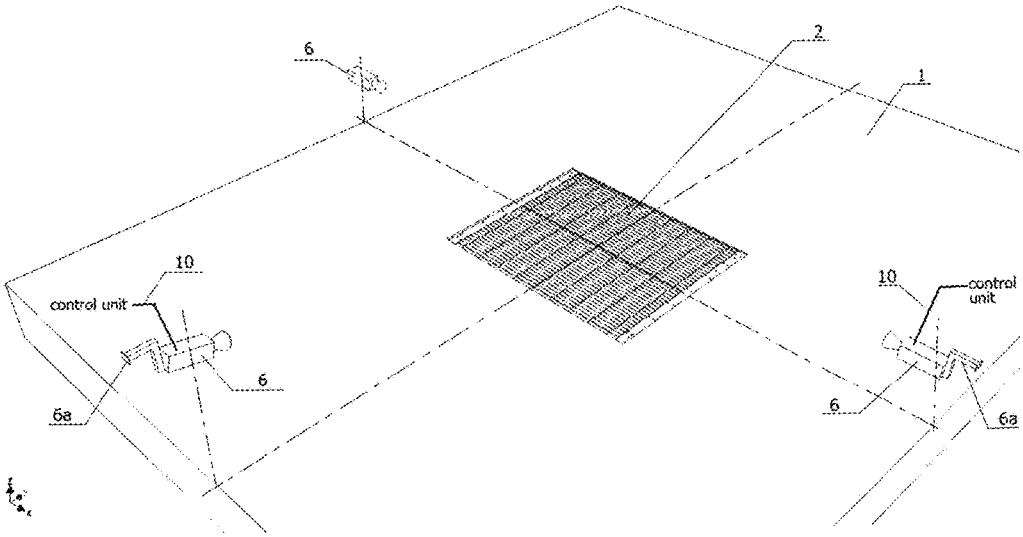
FIG. 8 shows a view of an optical scanning cameras system in perspective.
Figure 9:
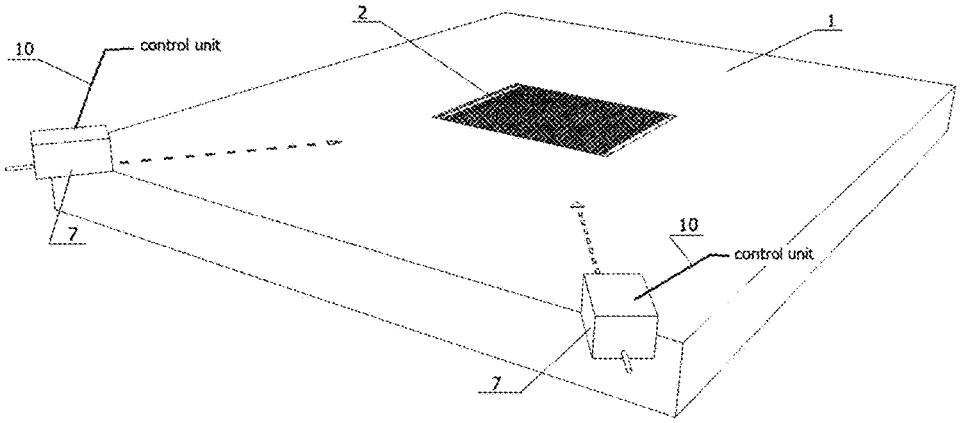
FIG. 9 is a view of a puck feeding system in perspective.
Figure 10:
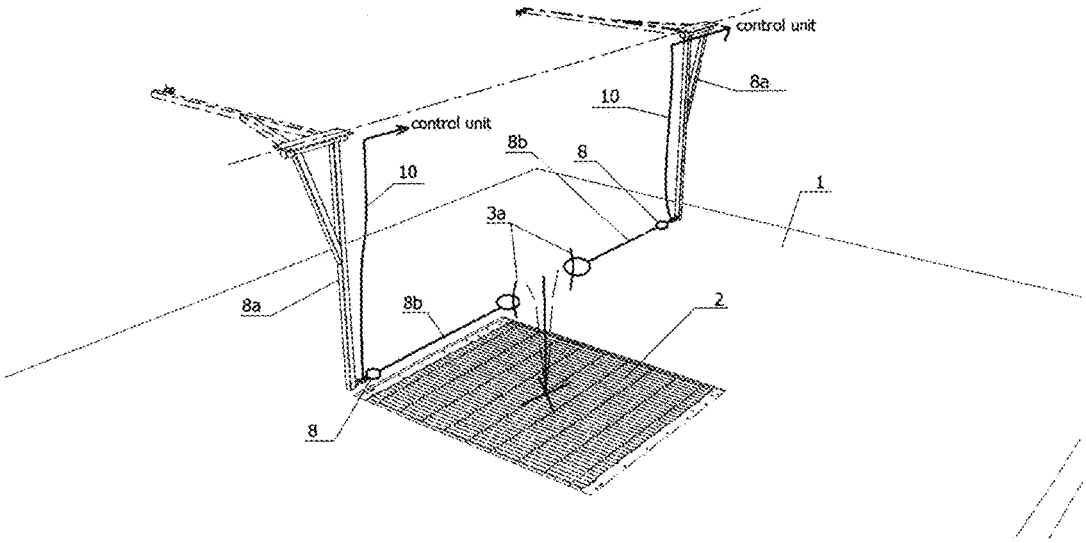
FIG. 10 shows a view of a tensile/compressive force measuring system for skaters or hockey players in perspective.
Figure 11:
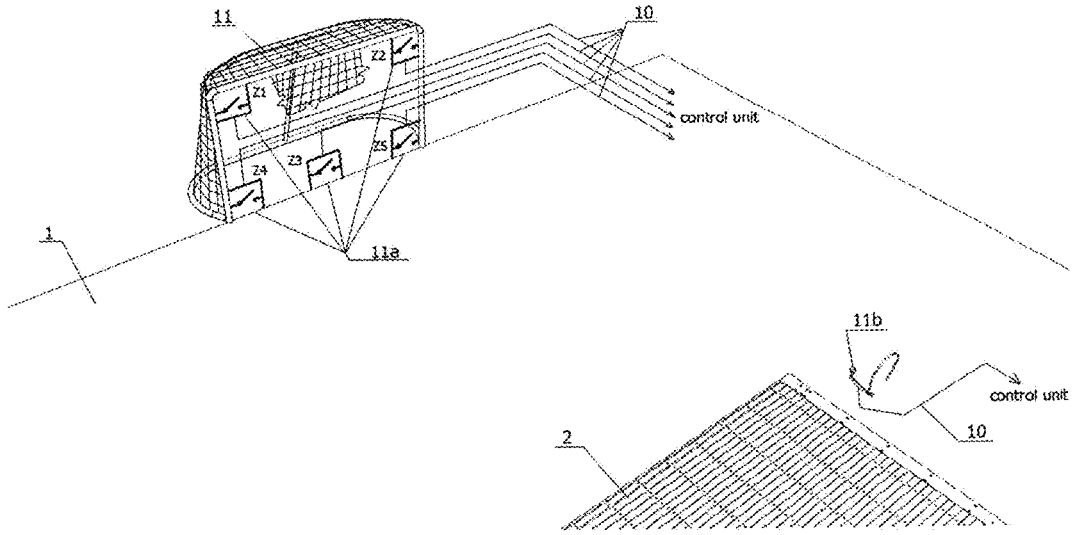
FIG. 11 is a view of a hockey goal structure with the sensors installed to detect puck hits on the target zones and with the sensor (acoustic microphone) for speech capture on a head-mounted holder.
Figure 13:
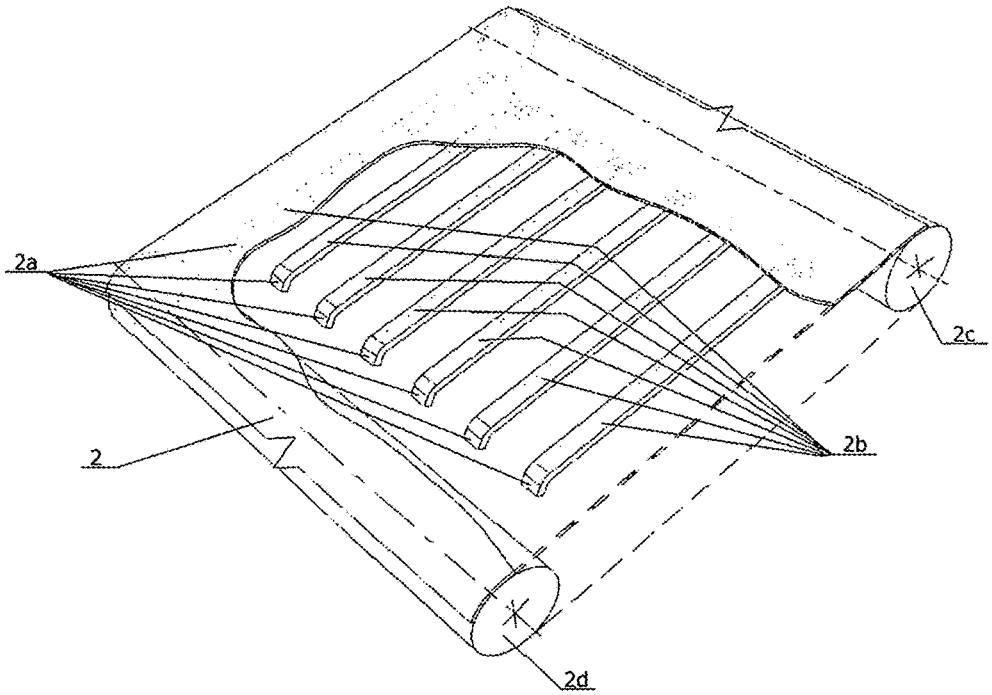
FIG. 13 is a schematic illustration of a skatemill belt supported by means of solid metal beams with the stationary sliding surfaces at the points of contact with the skatemill.
Figure 14:
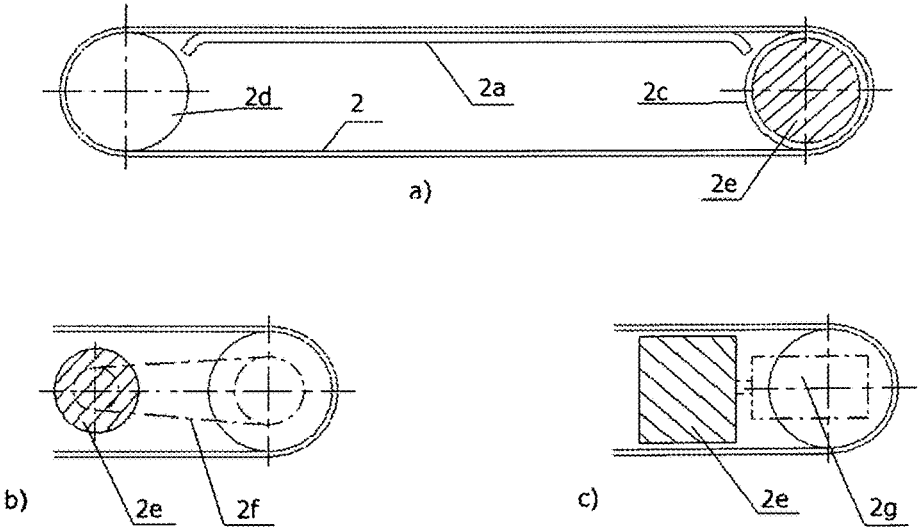
FIG. 14 shows schematics of three possible ways of moving the skatemill belt by an electric motor.
Figure 17:
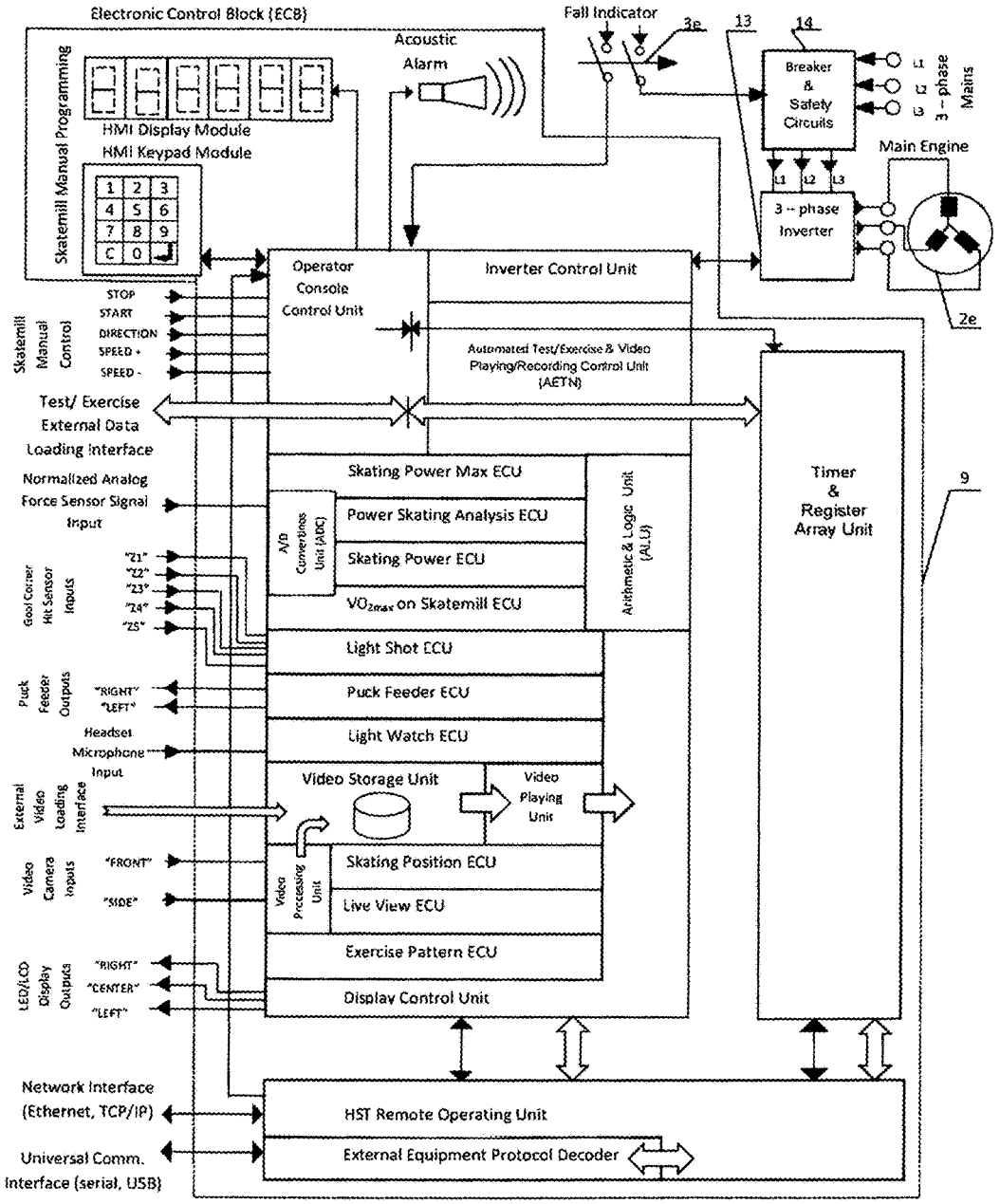
FIG. 17 is a block diagram of the electronic control block (ECB) of the integrated multi-purpose hockey skatemill with a system for the individual training and testing of the skating and hockey skills.

This example of a specific implementation of the invention describes a structure design of the integrated multipurpose hockey skatemill with its control/management system for the individual training and testing of the skating and hockey skills, in a maximum operational assembly modified for a hockey training center as depicted in the enclosed FIG. 1. It consists of a barrier-free work area made up from a stationary area of artificial ice 1 and a movable built-in skatemill belt 2 as depicted in the enclosed FIG. 3. Materials such as FunICE, Scan_ice, Xtraice, EZ-Glide etc. can be used as an artificial ice 1. The movable skatemill belt 2 comes as the so-called endless belt with its surface fitted with a material made of artificial ice. The skatemill belt is placed on two rotating load-bearing drums 2*c* and 2*d*. As shown in FIG. 14, 2*c* is a drive drum and 2*d* is a powered drum that are placed in ball bearings and on a shared support frame that is not depicted. The movable skatemill belt 2 is supported by solid metal beams 2*a*, as depicted in FIG. 13. These beams of the movable skatemill belt 2 touch it with nonmoving sliding surfaces 2*b*. On the boundary line defining a front side of the work area, extending the longitudinal axis of the movable skatemill belt 2, there is a hockey goal structure 11 with sensors 11*a* detecting puck hits on the target zones. The sensors are connected to the electronic control block 9 (ECB) via signal or data channels (metallic or wireless) 10, as depicted in FIG. 11. The sensor 11*b* monitoring verbal announcements of a hockey player, in this case an acoustic microphone, is located on a head-mount holder. It is connected to the electronic control block 9 (ECB) via signal or data channels (metallic or wireless) 10, as depicted in FIG. 11. Above the movable skatemill belt 2 is a top-hung safety restraint system 3 for skaters or hockey players, as depicted in FIG. 5. This comprises a personal harness system 3*a*, e.g. a full-body harness with a dorsal and adjustable straps 3*b* connected via carabiner clips 3*c* on one side to the skater's full body harness and on the other to the anchoring point 3*d* attached to a safety switch 3*e* that will stop the skatemill belt 2 from moving if pulled by the weight of the skater. The safety switch 3*e* slides on a horizontal guide rod 3*f* that is anchored on the first brackets 3*g*. Above the movable skatemill belt 2 is also a top-hung stabilization system 4 for skaters or hockey players, as depicted in FIG. 6. The system consists of two top-hung vertical beams 4*a* with the foldable horizontal handrails 4*b*, such as handlebars. The position of the beams, i.e. height from the surface of the work area, may be adjusted. The handrails 4*b* may be tipped into an upright position in parallel with the vertical beams. The vertical beams 4*a* are top-hung on the second brackets 4*c* over the side of the movable and stationary lines of the work surface so that the vertical beams 4*a* with unfolded handrails 4*b* do not interfere with the space above the skatemill 2. First brackets 3*g* and second brackets 4*c* may be combined into one common bracket. The suspension mechanism of the stabilization system 4 allows to tilt the vertical beams 4*a* with the handrails 4*b* facing up to the horizontal position as high as 2.2±0.1 m. At places defined by the intersections of the semicircular line, whose central point is identical with the center of the movable skatemill belt 2 and whose radius is 4.5±0.5 m, the arms of the angle from 70° up to 90° and with the vertex in the center of and symmetrical to the longitudinal axis of the movable skatemill belt 2, there are placed optical signalization/display elements 5 (left and right) hanging from the tiltable or vertically sliding brackets 5*a*. The middle optical signalization/display element 5 is located on the bracket 5*a* fitted on a line that is defined by the longitudinal axis of the movable skatemill belt 2, 6±1 m from its center. The suspension mechanism of the bracket 5*a* of the optical signalization/display element 5 allows to tilt the bracket 5*a* together with the optical signalization/display element 5 upwards to a horizontal position as high as 2.2±0.1 m. The optical signalization/display elements 5 are connected to the electronic control block 9 (ECB) via signal or data (metallic or wireless) channels 10, as depicted in FIG. 7. On the edges of the training zone and in vertical planes passing through the longitudinal and transverse axes of the movable skatemill belt 2, there are digital optical scanning cameras 6 fitted on brackets 6*a* and connected to the electronic control block 9 (ECB) via signal or data (metallic or wireless) channels 10, as depicted in FIG. 8. On the border line defining the front side of the work area, there are two puck feeders 7, as depicted in FIG. 9. The feeders are likewise connected to the electronic control block 9 (ECB) via signal or data (metallic or wireless) channels 10. On the two top-hung tiltable or vertically sliding brackets 8*a*, or on firm brackets (only in the case of the brackets located in the area behind the movable skatemill belt 2), and in the axis of the movable skatemill 2, 2.5±0.25 m from its center, there is a system measuring tensile/compressive forces by means of piezoelectric or tensiometric force-measuring sensors 8, as depicted in FIG. 10. Strength effect (tensile or compressive) exerted by a skater or a hockey player on the front and/or back sensor 8 is carried out by means of the front and/or back fibre handle 8*b* (tensile force) or solid rod (tensile and/or compressive force). Vertical position of the force sensor 8 may be set up within the range of 0.8 to 1.4 m. The suspension mechanism of the bracket 8*a* of the force sensor makes it possible to tilt the sensor's bracket 8*a* together with the force sensor 8 upwards to a horizontal position as high as 2.2±0.1 m. The force sensors 8 are connected to the electronic control block 9 (ECB) via signal or data (metallic or wireless) channels 10. The movable skatemill belt 2 is powered by a propulsion electric motor 2*e*, whereby the transmission connection between the electric motor 2*e* and the drive drum 2*c* of the movable skatemill belt 2 may be carried out in several alternative ways. The first alternative, as depicted in FIG. 13, represents a direct drive of the drive drum 2*c* of the movable skatemill belt 2, with the so-called drum electric motor 2*e* being directly built in the drive drum 2*c* itself. The second alternative, as depicted in FIG. 13, shows an example where a drive drum 2*c* of the movable skatemill belt 2 is powered by a propulsion electric motor 2*e* by means of a belt or chain transmission 2*f*. The third alternative, as depicted in FIG. 13, shows an example where a propulsion electric motor 2*e* powers a drive drum 2*c* of the movable skatemill belt 2 by means of a transmission 2*g* with the hard gear ratio. The propulsion electric motor 2*e* is in all cases a 3-phase asynchronous electric motor whose direction and rotational speed are continuously managed through a frequency converter 13 controlled by the electronic control block 9 (ECB), as depicted in FIG. 17. Emergency stop of the movable skatemill belt 2 in the event of a skater's a or a hockey player's fall is secured by a safety isolating switch disconnecting power supply for the propulsion electric motor 2*e* in the block of the power supply 14 which is directly managed by the switch of safety harness 3*e*, as depicted in FIG. 17.

Figure 18:
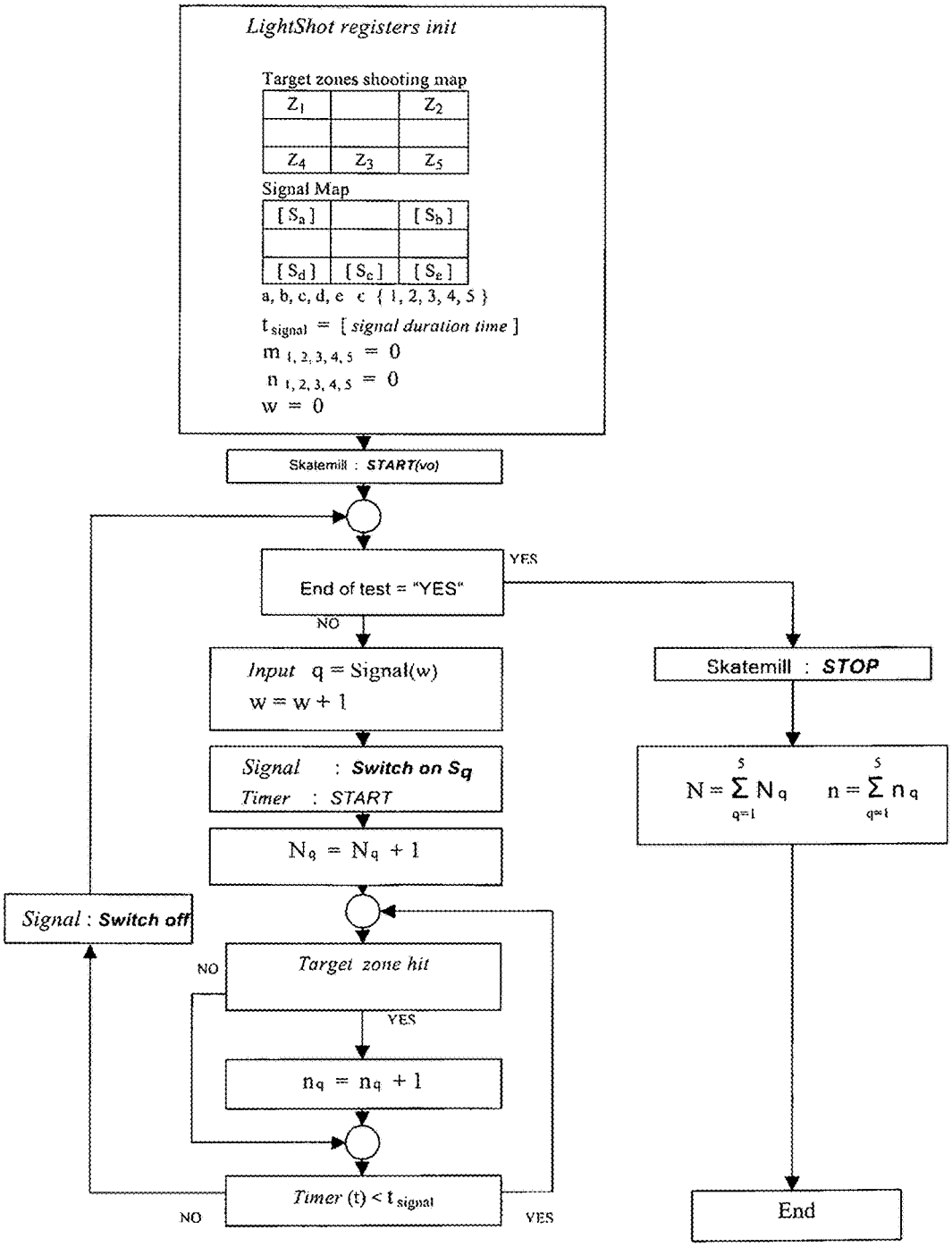
FIG. 18 represents a logic block diagram of the "LightShot" module of the electronic control block (ECB) used to control the skatemill during the LightShot training.
Figure 19:
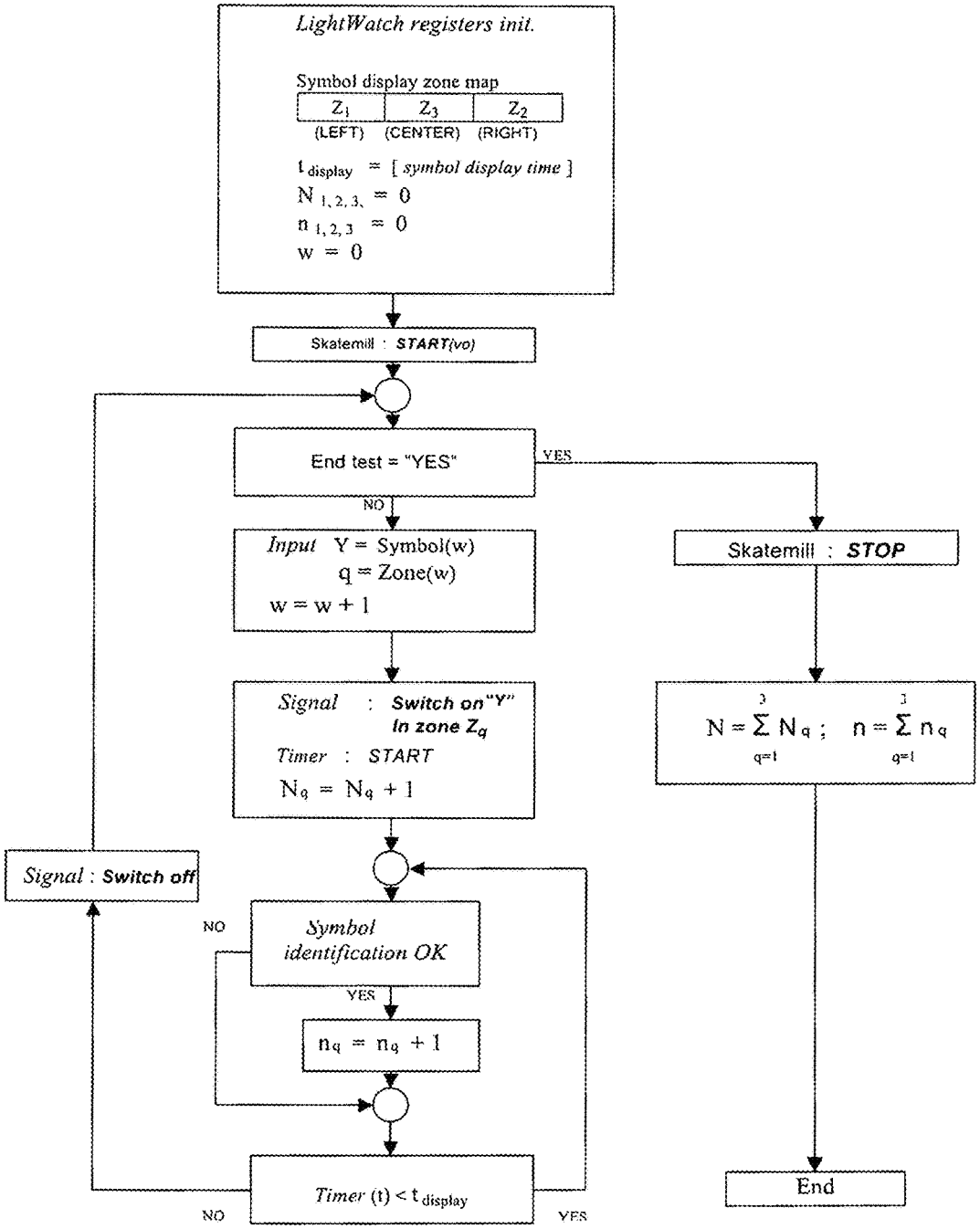
FIG. 19 represents a logic block diagram of the "LightWatch" module of the electronic control block (ECB) used to control the skatemill during the LightWatch training.
Figure 20:
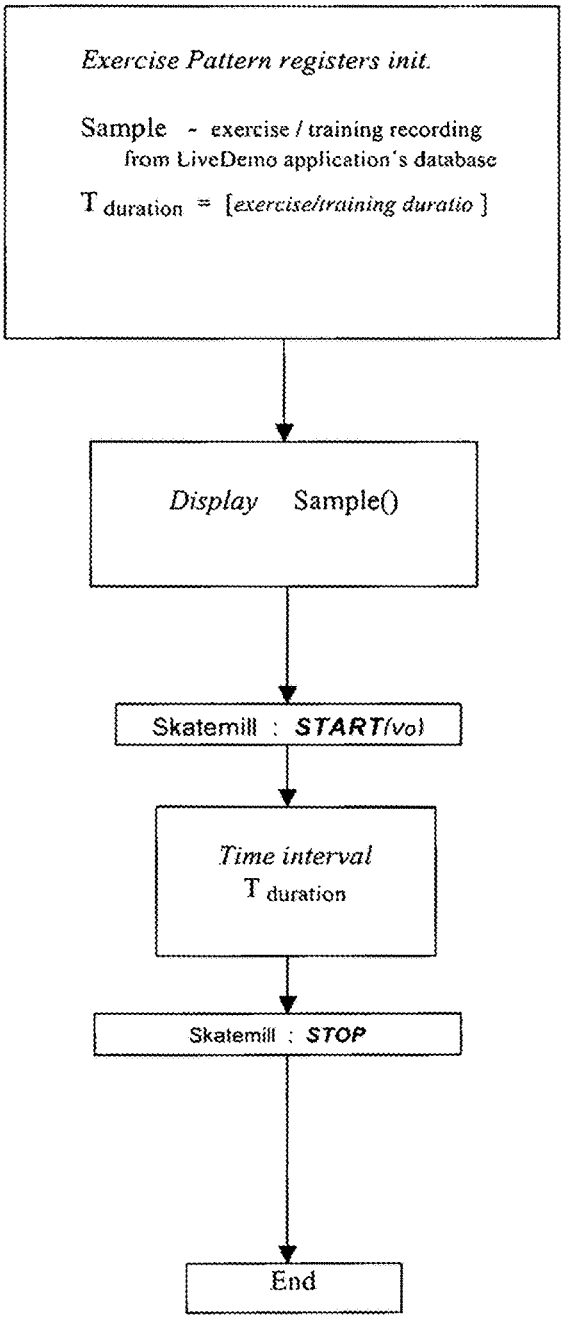
FIG. 20 represents a logic block diagram of the "Exercise Pattern" of the electronic control block (ECB) used to control the skatemill during the Exercise Pattern training.
Figure 21:
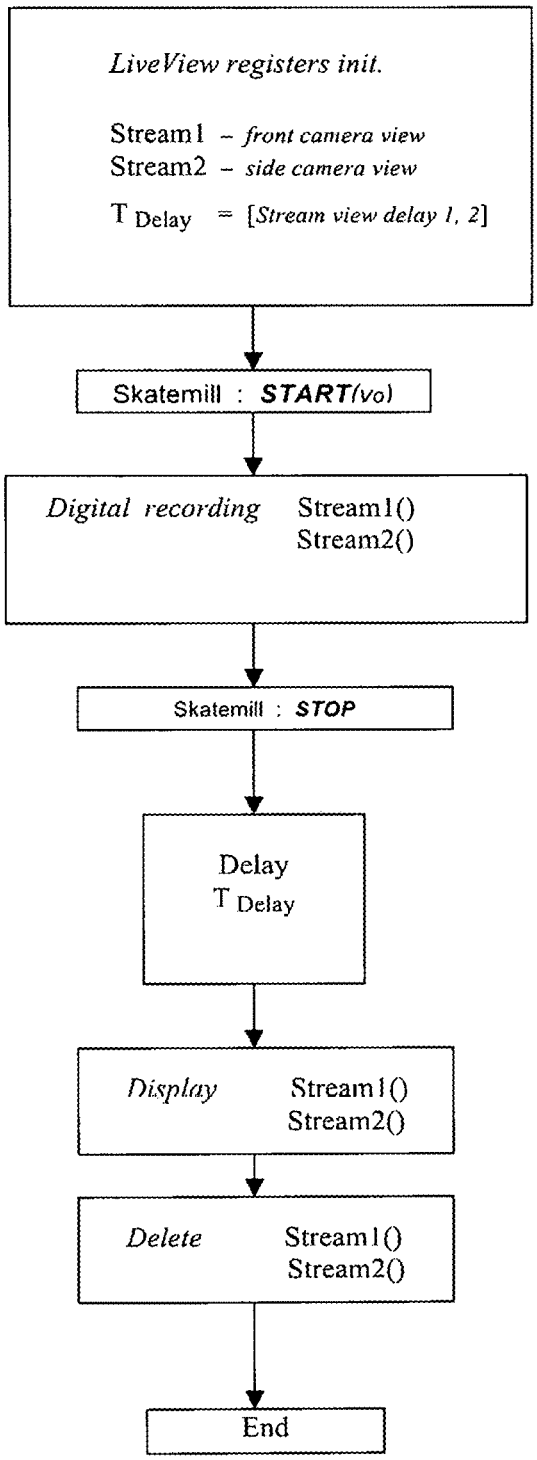
FIG. 21 represents a logic block diagram of the "LiveView" module of the electronic control block (ECB) used to control the skatemill during the LiveView training.
Figure 22:
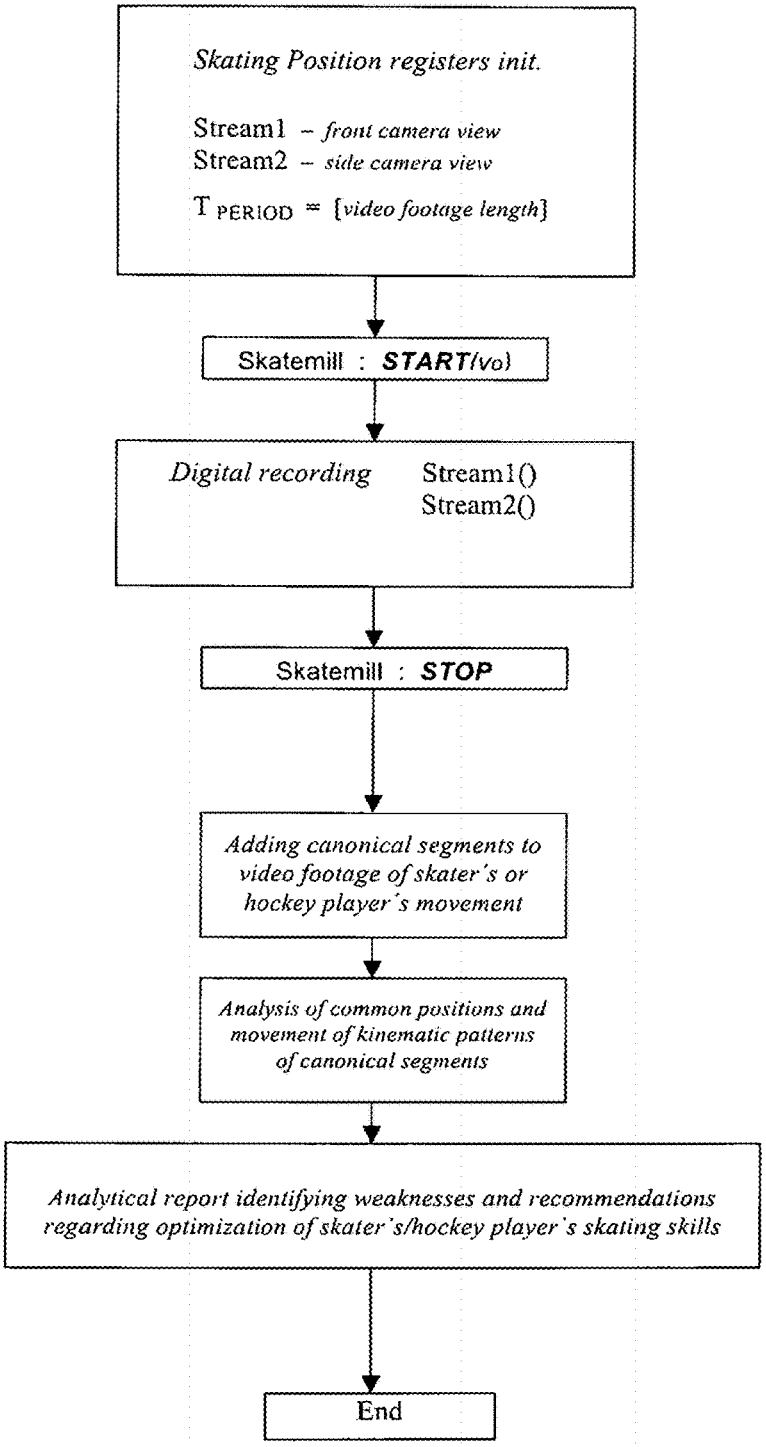
FIG. 22 represents a logic block diagram of the "Skating Position" of the electronic control block (ECB) used to control the skatemill during the SkatingPosition training.
Figure 23:
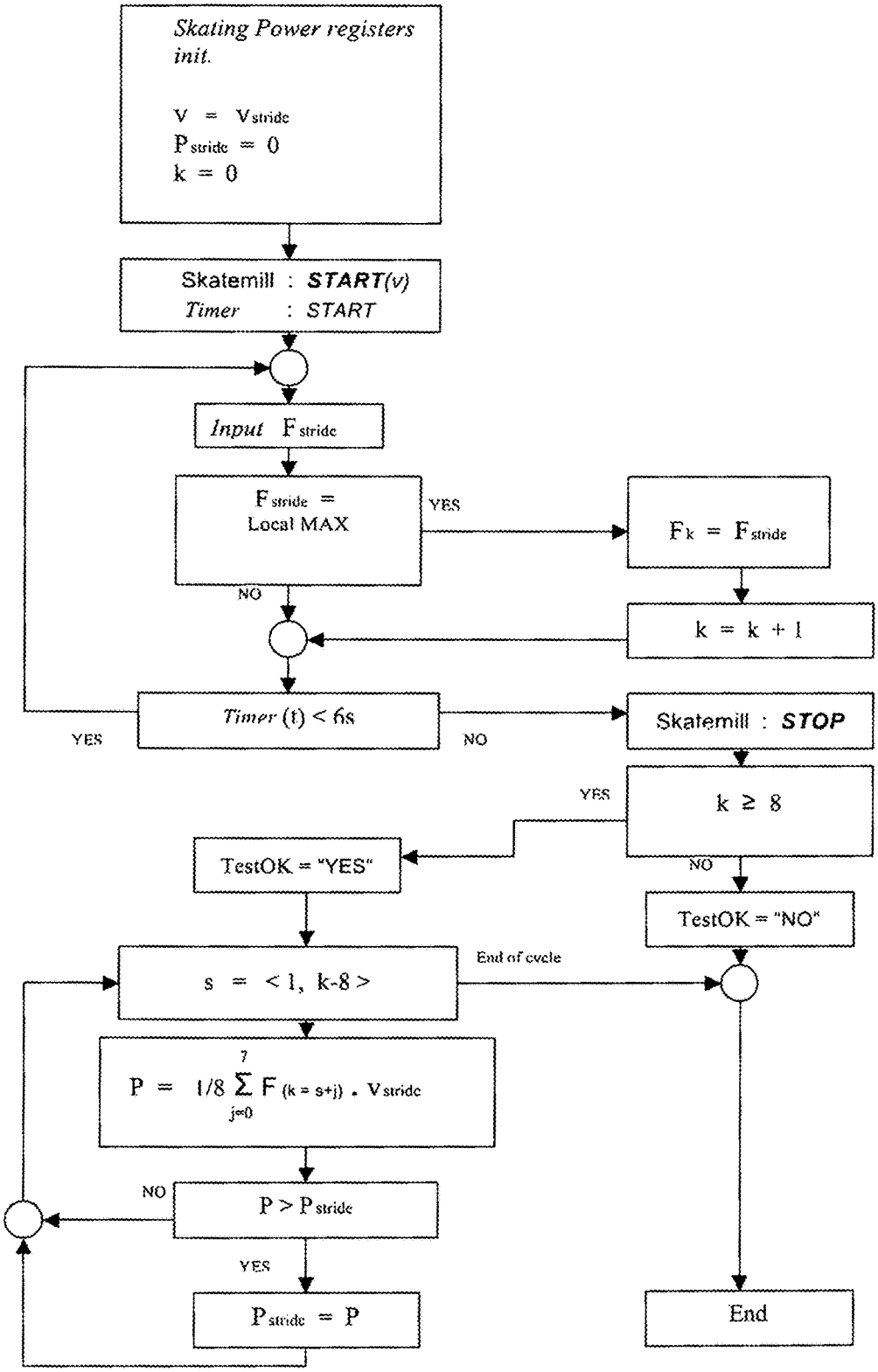
FIG. 23 represents a logic block diagram of the "Skating Power" of the electronic control block (ECB) used to control the skatemill during the Skating Power training.
Figure 24:
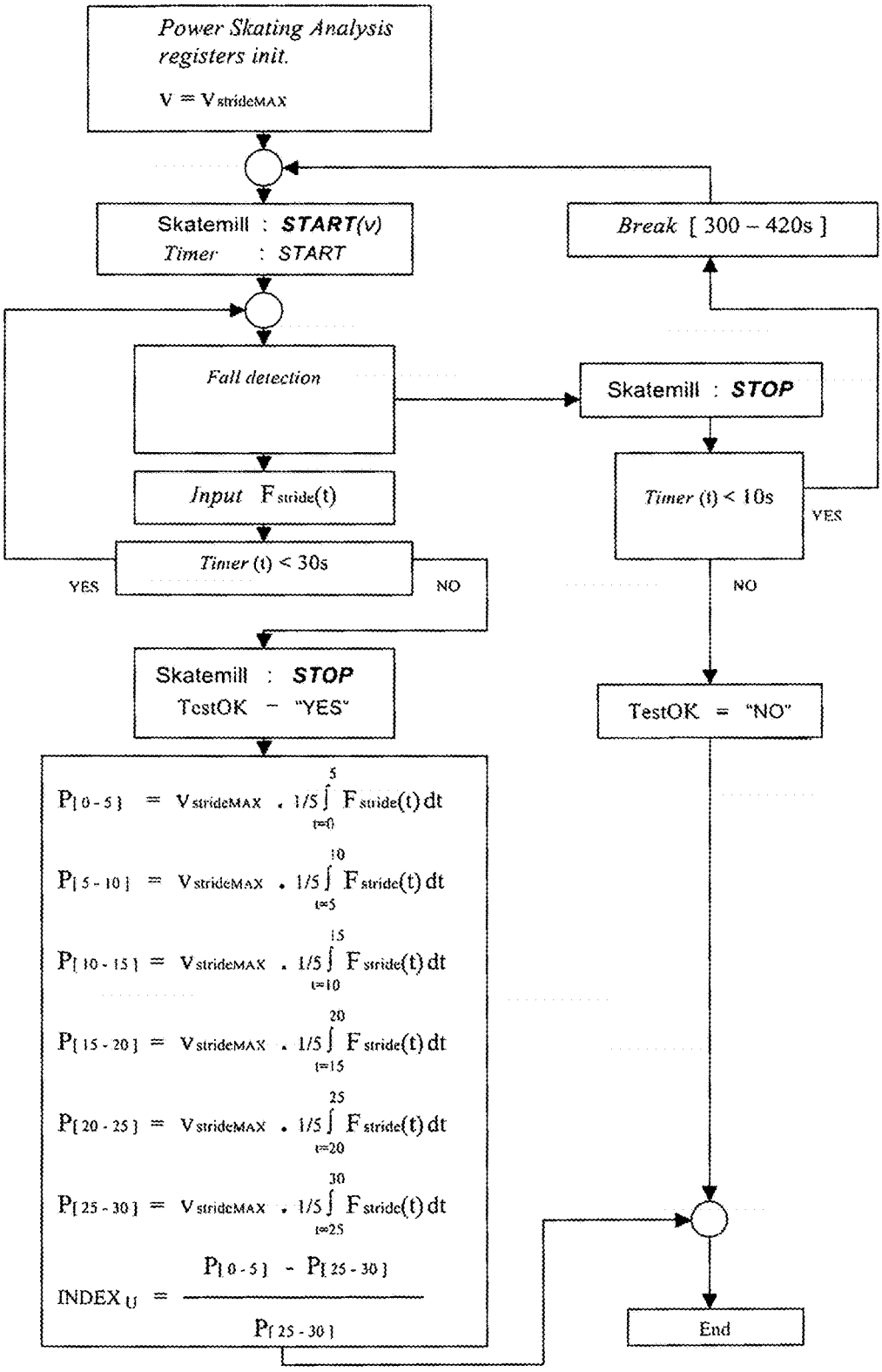
FIG. 24 represents a logic block diagram of the "Power-Skating Analysis" module of the electronic control block (ECB) used to control the skatemill during the Power Skating Analysis training.
Figure 25:
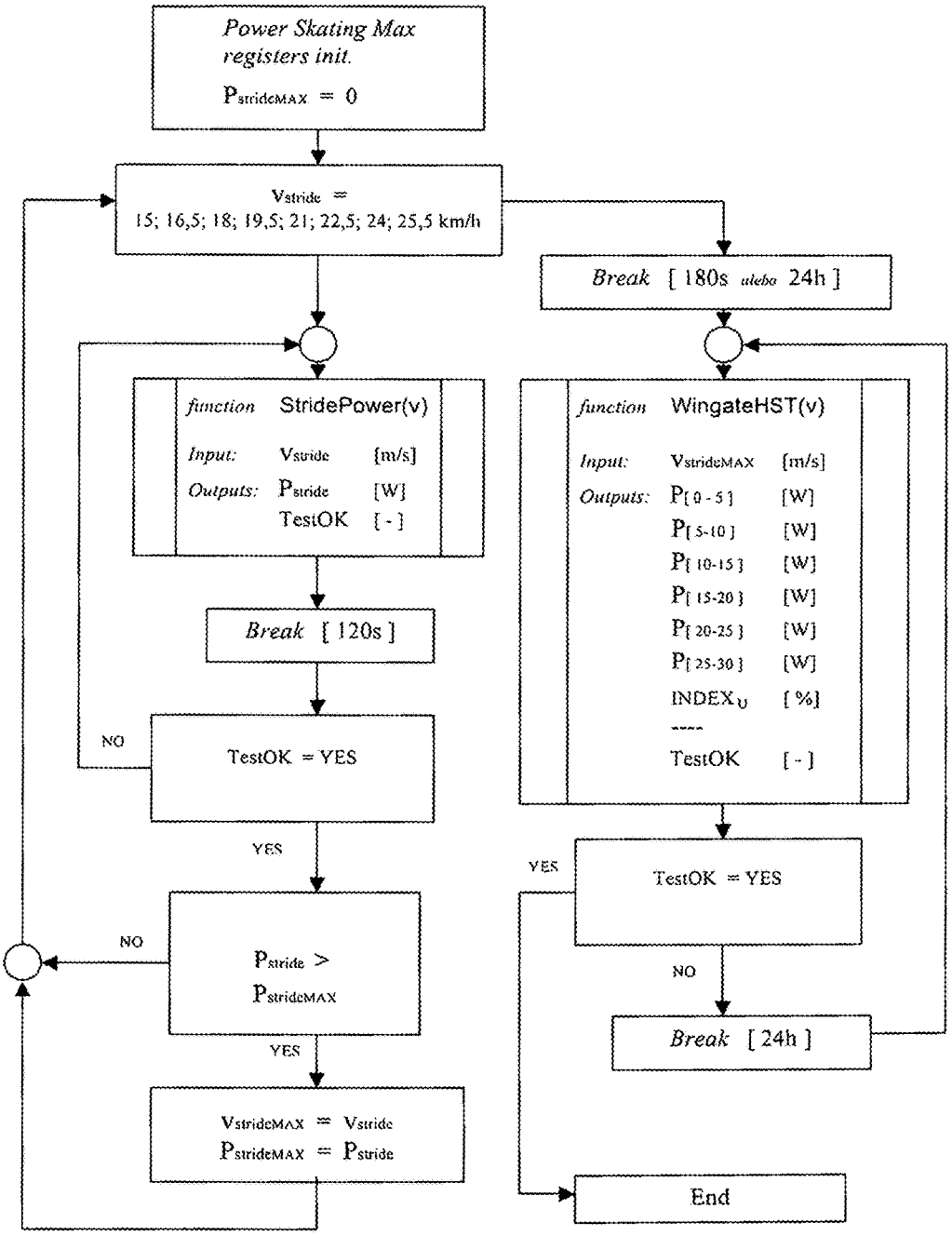
FIG. 25 represents a logic block diagram of the "Power-Skating Max" module of the electronic control block (ECB) used to control the skatemill during Power SkatingMax training.
Figure 26:
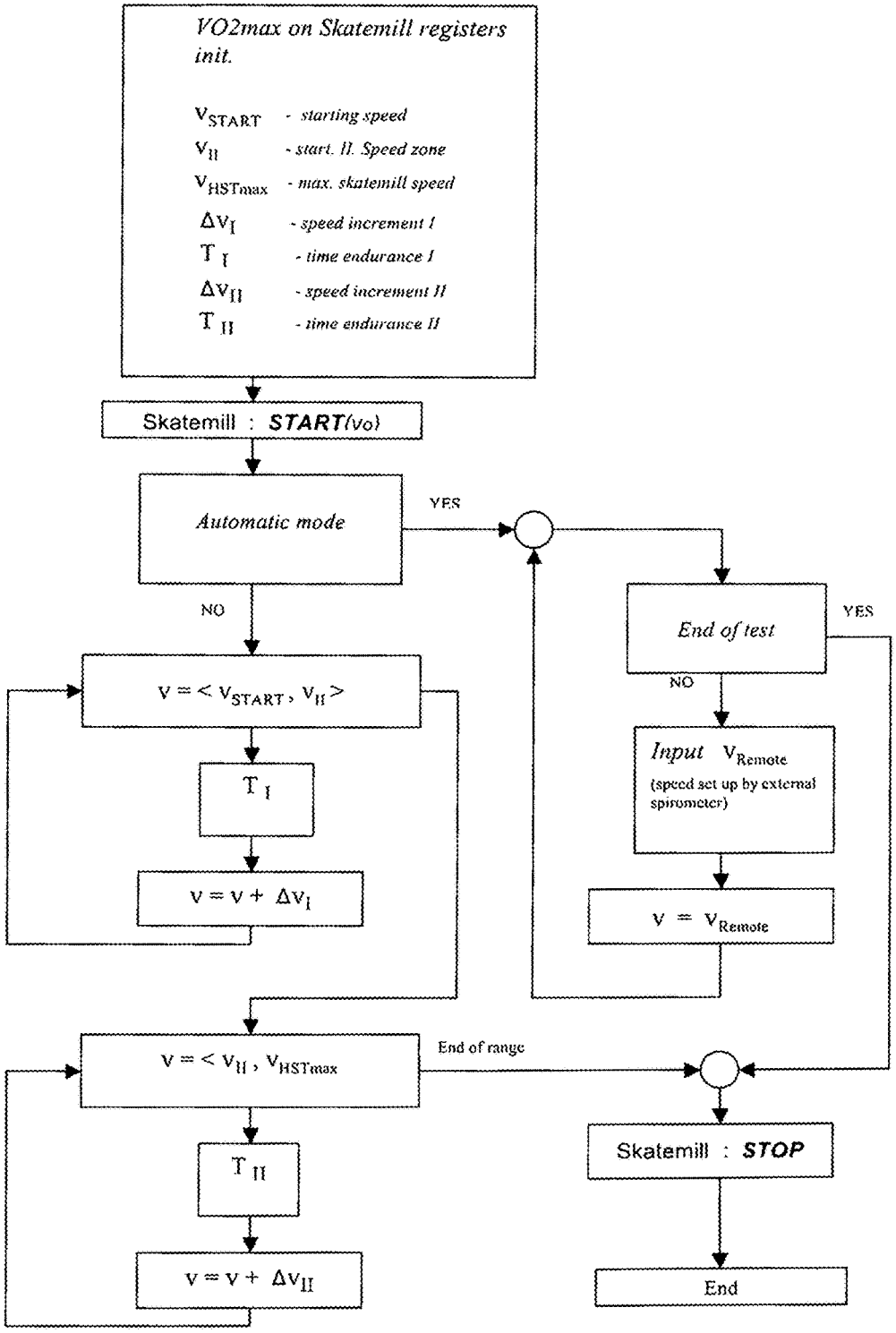
FIG. 26 represents a logic block diagram of the "$VO_{2max}$ on Skatemill" module of the electronic control block (ECB) used to control the skatemill during the $VO_{2max}$ on Skatemill training.

The electronic control block 9 (ECB) of the integrated multi-purpose hockey skatemill with a system for the individual training and testing of the skating and hockey skills is used by a skatemill operator or for automatic switch on or switch off control of the skatemill. It is also used to control the direction and speed of the movable skatemill belt 2 as well as to control individual operational or steerable elements of the skatemill while performing standard trainings and tests of skatemills. Individual elements of the skatemill may be managed in parallel by one or multiple control blocks of the electronic control block unit 9 (ECB), as depicted in FIG. 17. The electronic control block 9 (ECB) consists of the following operational blocks:

- "Automated Exercise/Test & Video Playing/Recording (AETV) Control Unit" which provides an internal system control, i.e. functional integration of the control blocks of the electronic control block unit 9 (ECB) on the electrical and logical level;
- "Inverter Control Unit" which provides control and monitoring of the status of a 3-phase frequency converter that manages the direction and rotational speed of the drive electric motor 2*e* of the movable skatemill belt 2;
- "Console Control Unit (Operator)" which enables the operator—by means of a manual interface comprising a display, a keyboard, functional buttons and an acoustic warning/signalization unit—to switch on/off the skatemill, to manage the direction and speed of the skatemill belt 2 and to set up the content of the control registers meant for managing functions of the individual control blocks. Part of the control block is also a signal interface "Exercise/Test External Data Loading Interface" that is meant for direct entry of data in the registers Timer & Register Array Unit and Fall Indicator that is intended for signalization of the safety system being activated in the event of a skater's or a hockey player's fall;
- "Timer & Register Array Unit" which stores the static (permanent) control parameters in the registers, e.g. time constants, preset speeds of the movable skatemill belt 2, files or sequence of the displayed symbols etc., test results such as files with the measured force sizes and operating parameters such as status indicators, counters, timers, i/o buffers etc.;
- "HST Remote Operation Unit" which secures connectivity of the control unit 9 (ECB) via the network interface "Ethernet" to the standard communication infrastructure, e.g. data network using TCP/IP protocol that allows to control the skatemill through the so-called remote console. Part of the control block is also a signal interface "Universal Communication Interface", e.g. serial RS-232 or USB intended for connecting an external spirometric or cardiopulmonary monitor in combination with a decoder for the communication protocol of the external device;
- "Display Control Unit" which serves to connect and control the display of given visual themes on the display/signalization elements. Part of the control block is also signal interfaces "LED/LCD Outputs" meant for connecting point, segment and flat imaging displays;
- "Video Recording Control Unit" which serves to connect optical video cameras to capture visual information obtained from the cameras. Part of the control block is also signal interfaces "Video Camera Inputs" intended for connecting digital optical scanning video cameras 6;
- "Video Storage Control Unit" is a data storage for permanent or temporary storage of visual information made by digital optical scanning (video) cameras. 6. Video Storage Control Unit can also store visual information (recordings) kept in the data storage via "External Video Loading Interface" of the electronic control block 9 (ECB) that serves for visual information transmission from external sources to the Video Storage Control Unit;
- "Video Playing Control Unit" which is used to select and manage the display of visual information stored in the Video Storage Control Unit. If necessary, the visual information can be displayed through Display Control Unit on the display/signalization elements 5;
- "Analog-to-Digital Conversion Unit (ADC)" which serves to convert analogue signal from the sensor 8 of the tensile or compressive forces exerted by skaters or hockey players into digital form. The operation of the ADC is managed by an active control block "Skating Power", "Power Skating Analysis", "Skating Power Max" or "$VO_{2max}$ on Skatemill". Part of the control block is also a signal interface "Normalized Analog Force Sensor Input" intended for connection to the analogue output of the force sensor 8;
- "Arithmetic-&-Logic Control Unit (ALU)" which is used to perform specific calculations and logical operations required for the calculation of the results (of speed performance profile, endurance performance profile and the fatigue index) while taking the "Skating Power", "Power Skating Analysis" and "Skating Power Max" tests, e.g. napr. finding the local maximum of the datasets, the calculation of the integral etc.;
- "Puck Feeder Control Unit" is used to manage the operation of one or two puck feeders 7. Part of the control block is also a signal interface "Puck Feeder Output(s)" intended for connecting electrically operated triggers of the puck feeders 7;

"LightShot Execution Control Unit (LightShot ECU)" is used for automated management of the "LightShot" training. A logic scheme of how the skatemill is managed by this block is depicted in FIG. 18. By means of an AETV and apart from its "Inverter Control Unit" functions, this control block uses also functions of other control blocks, such as "Display Control Unit" and "Puck Feed Machine Control Unit". Part of the control block is also a signal interface "Goal Corner Hit Sensor Inputs" for the impact sensors 11*a* of individual target zones set on the front of a hockey goal structure 11;

"LightWatch Execution Control Unit (LightWatch ECU)" is used for automated management of the "LightWatch" training. A logic scheme of how the skatemill is managed by this block is depicted in FIG. 19. By means of an AETV and apart from its "Inverter Control Unit" functions, this control block uses also functions of the other control block, namely "Display Control Unit". Part of the control block is also a signal interface "Headset Microphone INput" intended for connection of an acoustic microphone 11*b* designed for recording hockey player's verbal messages;

"Exercise Pattern Execution Control Unit (Exercise Pattern ECU)" is used for automated management of the "Exercise Pattern" training. A logic scheme of how the skatemill is managed by this block is depicted in FIG. 20. By means of an AETV and apart from its "Inverter Control Unit" functions, this control block uses also functions of other control blocks, such as "Display Control Unit" and "Video Playing Control Unit";

"LiveView Execution Control Unit (LiveView ECU)" is used for automated management of the "LiveView" training. A logic scheme of how the skatemill is managed by this block is depicted in FIG. 21. By means of an AETV and apart from its "Inverter Control Unit" functions, this control block uses also functions of other control blocks, such as "Video Recording Control Unit", "Video Storage Control Unit", "Video Playing Control Unit" and "Display Control Unit";

"Skating Position Execution Control Unit (Skating Position ECU)" is used for automated management of the "Skating Position" test. A logic scheme of how the skatemill is managed by this block is depicted in FIG. 22. By means of an AETV and apart from its "Inverter Control Unit" functions, this control block uses also functions of other control blocks, such as "Video Recording Control Unit" and "Video Storage Control Unit";

"Skating Power Execution Control Unit (Skating Power ECU)" is used for automated management of the "Skating Power" test. A logic scheme of how the skatemill is managed by this block is depicted in FIG. 23. By means of an AETV and apart from its "Inverter Control Unit" functions, this control block uses also functions of other control blocks of the 9 (ECB), such as "ADC" and "ALU";

"Power Skating Analysis Execution Control Unit (Power Skating Analysis ECU)" is used for automated management of the "Power Skating Analysis" test. A logical scheme of how the skatemill is managed by this block is depicted in FIG. 24. By means of an AETV and apart from its "Inverter Control Unit" functions, this control block uses also functions of other control blocks of the 9 (ECB), such as "ADC" and "ALU";

"Skating Power Max Execution Control Unit (Skating Power Max ECU)" is used for automated management of the "Skating Power Max" test. A logic scheme of how the skatemill is managed by this block is depicted in FIG. 25. By means of an AETV and apart from its "Inverter Control Unit" functions, this control block uses also functions of other control blocks of the 9 (ECB), such as "ADC" and "ALU";

"$VO_{2max}$ on Skatemill Execution Control Unit ($VO_{2max}$ on Skatemill ECU)" is used for automated management of the "$VO_{2max}$ on Skatemill" test. A logic scheme of how the skatemill is managed by this block is depicted in FIG. 26. By means of an AETV and apart from its "Inverter Control Unit" functions, this control block uses also functions of other control blocks of the 9 (ECB), such as "ADC" and "ALU". Part of the control block is also a signal interface "External Spirometer Input" designed for connecting an external spirometer or cardiopulmonary monitor. The external spirometric or cardiopulmonary monitor with its signal or data channel designed for being connected to the electronic control block 9 (ECB) is not depicted in this implementation example;

Logic and computing functions of the electronic control block 9 (ECB) and control blocks (ECU) are implemented by means of electronic elements—logic gates, flip-flop circuits, multiplexers, shift and memory registers, electronic RAM and ROM memories, large-capacity electromechanical memories (hard drives), integrated circuits for a particular use ASIC (used for implementation of the internal and external communication and signal interfaces, latches, counters and timers) and/or by means of gate arrays PGA/FPGA.

Figure 12:
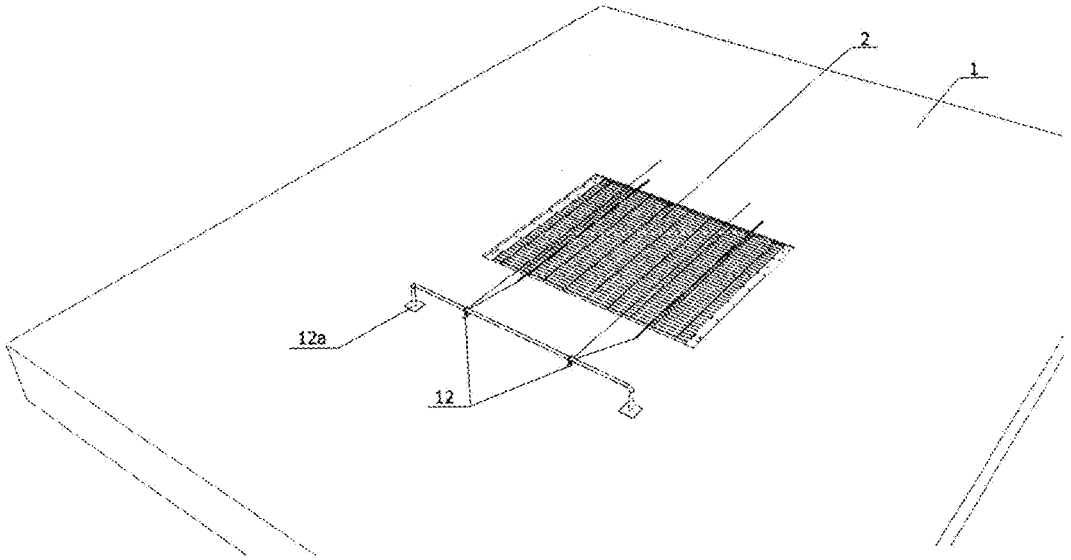
FIG. 12 shows a view of the assembly of laser markers on a detachable bracket.

It is possible to place two detachable laser markers 12 on optional mounts 12*a* on the stationary area of the artificial ice 1 facing the front border of the movable skatemill belt in order to define the width of the skate track, as depicted in FIG. 12.

Figure 2:
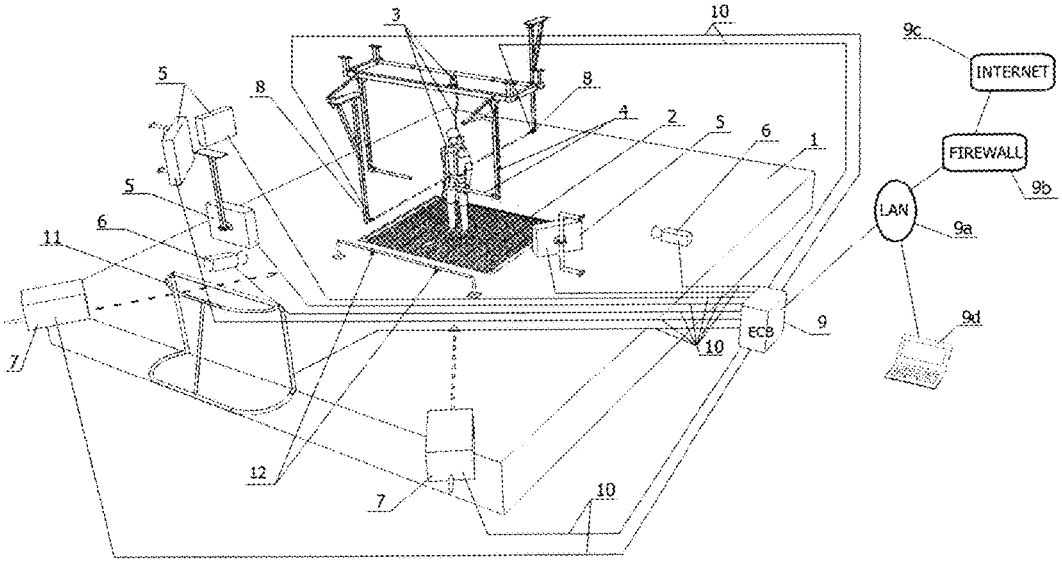
FIG. 2 shows a general view of the deployment of elements of the integrated multi-purpose hockey skatemill in a network configuration.

Alternatively, there is a solution for the integrated multi-purpose hockey skatemill in combination with a system for the individual training and testing of the skating and hockey skills as depicted in the FIG. 2 where the electronic control block 9 (ECB) is connected to a data LAN network 9*a*. This allows to manage or monitor functions of the skatemill remotely through the so-called control/management console 9*d*, i.e. by means of different networking equipment that makes it possible to implement the operator console comprising at least a display unit, e.g. graphic or character display device and a data input apparatus, e.g. a keyboard, touchpad or mouse or it is possible to remotely control or monitor the skatemill's functions by another automatic system. If the LAN data network 9*a* is a communication gate or a firewall 9*b* connected to the Internet 9*c*, it is possible to remotely control or monitor the skatemil through a control/management console 9*d* connected via the Internet.

Example 2—LightShot

The integrated multi-purpose hockey skatemill with a system for the individual training and testing of the skating and hockey skills described in Example 1 can be used in combination with the control block "LightShot ECU" of the electronic control block 9 (ECB) for automated management of the movement of the movable skatemill belt 2, for automated management of the optical signalization/display elements 5 and for automated recording of signals from the sensors 11*a* detecting impacts on the target zones during the LightShot training on the skatemill. FIG. 18 depicts a method for controlling the integrated multi-purpose hockey skatemill by the electronic control block 9 (ECB) equipped with the "LightShot ECU" during the LightShot training. Signal connections between the integrated multi-purpose electronic block 9 (ECB) are depicted in FIG. 17.

In such case, i.e. during the LightShot training, the electronic control block 9 (ECB) of the skatemill controls a frequency converter 13, by means of which it manages (switches on) the movement of the movable skatemill belt 2 so that it moves at a (set) speed. It also controls the display of light or optical signals $S_1$-$S_5$ on a flat display of the middle optical siganalization/display element 5 in the zones $Z_1$="LEFT TOP CORNER", $Z_2$="RIGHT TOP CORNER", $Z_3$="BOTTOM CENTER", $Z_4$="LEFT BOTTOM CORNER" and $Z_5$="RIGHT BOTTOM CORNER" in any given or random order. A hockey player skating on the running skatemill belt 2 reacts to these light stimuli by shooting a puck into a given target zone Z defined for instance on the frontal plane of a hockey goal structure 11. Unless the hockey player shoots the puck within certain time "$t_{signal}$", the application will evaluate it as a failed attempt. After the test, the electronic control block 9 (ECB) of the skatemill will stop the skatemill belt 2 from moving. The total number of signals sent out by the application $N=\Sigma N_q$, q=1-5 and the count of impacts on the given target zone $n=\Sigma n_q$, q=1-5 achieved by the hockey player within a given time are recorded in an automated or non-automated way. At the same time these data represent the test result. By setting up the so-called mapping vector of signals in any other way than in the "1:1" scheme represented by incidence rate of signals and target zones: $S_1 \rightarrow Z_1$, $S_2 \rightarrow Z_2$, $S_3 \rightarrow Z_3$, $S_4 \rightarrow Z_4$ a $S_5 \rightarrow Z_5$, it is possible to set up any other incidence (mapping) of signals S and target zones Z, e.g. $S_1 \rightarrow Z_2$, $S_2 \rightarrow Z_1$, $S_3 \rightarrow Z_3$, $S_4 \rightarrow Z_4$ a $S_5 = Z_5$, or e.g. $S_1 \rightarrow Z_4$, $S_2 \rightarrow Z_5$, $S_3 \rightarrow Z_3$, $S_4 \rightarrow Z_1$ a $S_5 \rightarrow Z_2$ etc., thus making it possible to adjust the level of training difficulty to the needs of hockey players. Automated detection of impacts on the target zones is provided by the electronic control block 9 (ECB) by means of mechanical contact or piezoelectric or contactless optical or inductive impact detection sensors 11*a* placed in the target zones $Z_1$-$Z_5$ of a hockey goal structure 11 located in front of the movable skatemill belt 2, on the border line defining the front side of the work area in the extension of the longitudinal axis of the movable skatemill belt 2.

As a variant, during the LightShot training, the electronic control block 9 (ECB) of the skatemill can also manage puck feeders 7 in such a way that their (puck feeders) operation is coordinated with the course of the LightShot training, i.e. actions of the puck feeders 7 (shooting of a puck) are time-synchronized with the expected moment of a hockey player's launching a shot. All this happens following the display of a light navigation symbol.

Example 3—LightWatch

The integrated multi-purpose hockey skatemill with a system for the individual training and testing of the skating and hockey skills, as described in Example 1, can be used in a similar way to the previous example in combination with the electronic block "LightWatch ECU" of the electronic control unit 9 (ECU). It can be used for automated management of the movement of the skatemill belt 2, for automated management of optical signalization/display elements 5, as well as for automated recording of signals from the detection sensors 11*a* picking up the impacts on the target zones and an acoustic microphone, which is a sensor 11*b* monitoring/recording verbal messages of a hockey player during the LightWatch training on the integrated multi-purpose hockey skatemill. FIG. 19 depicts a method for controlling the integrated multi-purpose hockey skatemill by the electronic control block 9 (ECB) equipped with the "LightWatch ECU" during the LightWatch training. Signal connections between the integrated multi-purpose electronic block 9 (ECB) are depicted in FIG. 17.

In such case, i.e. during the LightWatch training, the electronic control block 9 (ECB) of the skatemill controls a frequency converter 13, by means of which it manages (switches on) the movement of the movable skatemill belt 2 so that it moves at a (set) speed. It also controls the display of light signals Y={0-9|00-99|aA-zZ|m■●▲} (i.e. numbers and digits, alphabetic characters and simple geometric figures) apart from the central display element 5, also on the display elements positioned in the LEFT zone and in the RIGHT zone of a hockey player's peripheral vision in any given or random order. A hockey player who is skating on the moving skatemill belt 2 responds to these light stimuli via identifying and verbalizing a symbol and/or doing something else, e.g. shooting at the predetermined target zone. After the test, the electronic control block 9 (ECB) stops the movement of the skatemill belt 2. The total number of the signals sent by the application $N=\Sigma N_q$, q=1-5 and the number of correctly identified symbols by a hockey player within the time limit "$t_{display}$" $n=\Sigma n_q$, q=1-5 are logged automatically or non-automatically. These data represent the test results. Automated detection of the correctly identified symbols in the case of their verbalization by a hockey player is provided by the electronic control block 9 (ECB) using a speech recognition system. An acoustic microphone 11*b* monitoring verbal messages of a hockey player is in this case placed on a protective helmet of the hockey player or on the headset holder. Alternatively, if the hockey player responds to the visualized signals by shooting to the designated zones, the automated detection of the impacts on the target zones is provided by the electronic control block 9 (ECB) by means of mechanical contact or piezoelectric or the contactless optical and inductive sensors fitted in the target zones of a 11 hockey goal $Z_1$-$Z_5$ placed in front of the skatemill belt 2 on the borderline defining the front side of the work area in the extension of the longitudinal axis of the skatemill belt 2.

Example 4—Exercise Pattern

The integrated multi-purpose hockey skatemill with a system for the individual training and testing of the skating and hockey skills, as described in Example 1, can be used in a similar way to the previous example in combination with the electronic block "Exercise Pattern ECU" of the electronic control unit 9 (ECU). It can be used for automated management of the movement of the skatemill belt 2 and for automated management of optical signalization/display elements 5 during the Exercise Pattern training on the integrated multi-purpose hockey skatemill. FIG. 20 depicts a method for controlling the integrated multi-purpose hockey skatemill by the electronic control block 9 (ECB) equipped with the "Exercise Pattern ECU" during the Exercise Pattern training. Signal connections between the integrated multi-purpose electronic block 9 (ECB) are depicted in FIG. 17.

During the Exercise Pattern training, on one or more display elements, the electronic control block (ECB) of the skatemill shows a recorded digital video footage "Sample( )" of the practice or exercise a skater or a hockey player on the skatemill should carry out. After viewing the video recording of the practice or exercise, the electronic control block 9 (ECB), by means of a frequency converter 13, controls (switches on) the movement of the skatemill belt 2 so that it could move at the default (set) speed. After the given time "Tduration" planned to carry out the training or exercise has elapsed, the ECB stops the movement of the skatemill belt 2.

Example 5—LiveView

The integrated multi-purpose hockey skatemill with a system for the individual training and testing of the skating and hockey skills, as described in Example 1, can be used in a similar way to the previous example in combination with the electronic block "LiveView ECU" of the electronic control unit 9 (ECU). It can be used for automated management of the movement of the skatemill belt 2 and for automated management of optical signalization/display elements 5 during the LiveView training on the integrated multi-purpose hockey skatemill. FIG. 21 depicts a method for controlling the integrated multi-purpose hockey skatemill by the electronic control block 9 (ECB) equipped with the "LiveView ECU" during the LiveView training. Signal connections between the integrated multi-purpose electronic block 9 (ECB) are depicted in FIG. 17.

During the LiveView training, by means of a frequency converter 13, the electronic control block 9 (ECB) of the skatemill controls (switches on) the movement of the skatemill belt 2 so that it could move at the default (set) speed. The ECB also manages the creation and temporary storage of digital video recordings (the front "StreamRecord1" and the side "StreamRecord2") and a delayed (with a delay "Tdelay"=<5 s-15 min>) presentation of the created video recordings of a prior exercise or training performed by a skater or a hockey player on the skatemill belt 2. If the delay "Tdelay" is set at the same time as the duration of an exercise (training), it is possible for the skater or the hockey player to watch his very own just finished exercise or training in order to realize their potential shortcomings committed at the training.

Example 6—Skating Position

The integrated multi-purpose hockey skatemill with a system for the individual training and testing of the skating and hockey skills, as described in Example 1, can be used in a similar way to the previous example in combination with the electronic block "Skating Position ECU" of the electronic control unit 9 (ECU). It can be used for automated management of the movement of the skatemill belt 2, for automated management of optical signalization/display elements 5 as well as for the optical scanning cameras 6 during the Skating Position test on the integrated multi-purpose hockey skatemill. FIG. 22 depicts a method for controlling the integrated multi-purpose hockey skatemill by the electronic control block 9 (ECB) equipped with the "Skating Position ECU" during the Skating Position test. Signal connections between the integrated multi-purpose electronic block 9 (ECB) are depicted in FIG. 17.

During the Skating Position test, by means of a frequency converter 13, the electronic control block 9 (ECB) of the skatemill controls (switches on) the movement of the skatemill belt 2 so that it could move at the default (set) speed. The ECB also manages the creation and storage of digital video recordings of the course of the skating performed by a skater or a hockey player on the movable skatemill belt from the front (StreamRecord1) and the side (StreamRecord2) views. After the test, i.e. after the time "$T_{PERIOD}$" has elapsed, the electronic control block 9 (ECB) stops the movement of the skatemill belt 2. Following that, canonical segments are added to the digital video recordings, e.g. in MPEG4 format, via video editing tools in either automated or non-automated way. The canonical segments represent positions of the lower extremities or their parts, mutual positions and kinematic movement patterns whose canonical segments are further analyzed in order to identify shortcomings and/or optimize skating skills of a skater or a hockey player.

Example 7—Skating Power

The integrated multi-purpose hockey skatemill with a system for the individual training and testing of the skating and hockey skills, as described in Example 1, can be used in a similar way to the previous example in combination with the electronic block "Skating Power ECU" of the electronic control unit 9 (ECU). It can be used for automated management of the movement of the skatemill belt 2 and for automated measuring and recording of the tensile or compressive force exerted by a skater or a hockey player during the Skating Power test on the integrated multi-purpose hockey skatemill. FIG. 23 depicts a method for controlling the integrated multi-purpose hockey skatemill by the electronic control block 9 (ECB) equipped with the "Skating Power ECU" during the Skating Power test. Signal connections between the integrated multi-purpose electronic block 9 (ECB) are depicted in FIG. 17.

During the Skating Power test, by means of a frequency converter 13, the electronic control block 9 (ECB) of the skatemill controls the speed of the skatemill belt 2 so that it could move at required speeds in order to determine a skater's or a hockey player's speed performance profile. The ECB also controls measuring and recording of data on values of the tensile or compressive force exerted by a skaters or hockey players during the test.

The speed performance profile for a skater or a hockey player is laid as an 8-element sequence of the values of power (expressed in watts) exerted by a skater or a hockey player while skating on a level surface facing forward in eight different reference skating speeds, as follows: 15.0-16.5-18.0-19.5-21.0-22.5-24.0-25.5 km/h. Power given by skater is determined by the method described below.

From the measured tensile or compressive forces respectively, one measures the power attained by a skater or a hockey player in each of the eight reference skating speeds "$v_{stride}$" 15.0-16.5-18.0-19.5-21.0-22.5-24.0-25.5 km/h by relation:

$$P = 1/8\sum_{k=1}^{8} F_k \cdot v_{stride}[W, N, \mathrm{ms}_{-1}]$$

in which "P" stands for performance exerted by a skater or a hockey player, "k" is the serial number of a skating stride in an 8-step series and "$F_k$" represents the maximum tensile or compressive forces exerted by a skater or a hockey player as measured by the sensor for measuring the force in the skating stride "k".

Between the respective tests, i.e. between the tests at the reference speeds 15.0-16.5-18.0-19.5-21.0-22.5-24.0-25.5 km/h are included relaxation intervals of not less than 120 seconds.

Example 8—Power Skating Analysis

The integrated multi-purpose hockey skatemill with a system for the individual training and testing of the skating and hockey skills, as described in Example 1, can be used in a similar way to the previous example in combination with the electronic block "Power Skating Analysis ECU" of the electronic control unit 9 (ECU). It can be used for automated management of the movement of the skatemill belt 2 and for automated measuring and recording of the tensile or compressive force exerted by a skater or a hockey player during the Power Skating Analysis test on the integrated multi-purpose hockey skatemill. FIG. 24 depicts a method for controlling the integrated multi-purpose hockey skatemill by the electronic control block 9 (ECB) equipped with the "Power Skating Analysis ECU" during the Power Skating Analysis test. Signal connections between the integrated multi-purpose electronic block 9 (ECB) are depicted in FIG. 17.

During the Power Skating Analysis test, by means of a frequency converter 13, the electronic control block 9 (ECB) of the skatemill controls (switches on) the movement of the skatemill belt 2 so that it could move at a given (set) speed "$v_{strideMAX}$" in order to determine a skater's or a hockey player's endurance performance profile and fatigue index. The electronic control block 9 (ECB) also controls measuring and recording of data on values of the tensile or compressive force exerted by skaters or hockey players during the test.

The endurance performance profile is determined as the 6-element sequence of average values of power ($P_{[0-5]}$, $P_{[5-10]}$, $P_{[10-15]}$, $P_{[15-20]}$, $P_{[20-25]}$, $P_{[25-30]}$ expressed in watts) exerted be a skater while skating on a level surface facing forward in 6 different time intervals: <0-5 s>, <5-10 s>, <10-15 s>, <15-20 s>, <20-25 s>, <25-30 s> by the relations:

$$P_{[0-5]} = v_{strideMAX} \cdot 1/5 \int_{t=0}^{5} F_{stride}(t)dt \quad [W, \mathrm{ms}_{-1}, N]$$

$$P_{[5-10]} = v_{strideMAX} \cdot 1/5 \int_{t=5}^{10} F_{stride}(t)dt \quad [W, \mathrm{ms}_{-1}, N]$$

$$P_{[10-15]} = v_{strideMAX} \cdot 1/5 \int_{t=10}^{15} F_{stride}(t)dt \quad [W, \mathrm{ms}_{-1}, N]$$

$$P_{[15-20]} = v_{strideMAX} \cdot 1/5 \int_{t=15}^{20} F_{stride}(t)dt \quad [W, \mathrm{ms}_{-1}, N]$$

$$P_{[20-25]} = v_{strideMAX} \cdot 1/5 \int_{t=20}^{25} F_{stride}(t)dt \quad [W, \mathrm{ms}_{-1}, N]$$

$$P_{[25-30]} = v_{strideMAX} \cdot 1/5 \int_{t=25}^{30} F_{stride}(t)dt \quad [W, \mathrm{ms}_{-1}, N]$$

in which "$P_{[\ ]}$" is average power exerted by a skater or a hockey player within the measured 5-second interval and "$F_{stride}(t)$" is a function that expresses time dependency of the tensile or compressive forces exerted by a skater or a hockey player as measured by the sensor for measuring the force in the measured 5-second interval.

Fatigue index of a skater or a hockey player is the extent (size) of the power loss exerted by a skater or a hockey player at the start, in time interval <0-5 s> and at the end, in time interval <25-30 s> of the Power Skating Analysis test. It is expressed in % of the extent of power loss and the average performance attained by a skater in the interval <0-5 s> by the relation in %:

$$\mathrm{INDEX}_U = \frac{P_{[0-5]} - P_{[25-30]}}{P_{[25-30]}} \cdot 100\% \quad [\%]$$

Example 9—Power Skating Max

The integrated multi-purpose hockey skatemill with a system for the individual training and testing of the skating and hockey skills, as described in Example 1, can be used in a similar way to the previous example in combination with the electronic block "Power Skating Max ECU" of the electronic control unit 9 (ECU). It can be used for automated management of the movement of the skatemill belt 2 and for automated measuring and recording of the tensile or compressive force exerted by a skater or a hockey player during the Power Skating Max test on the integrated multi-purpose hockey skatemill. FIG. 25 depicts a method for controlling the integrated multi-purpose hockey skatemill by the electronic control block 9 (ECB) equipped with the "Power Skating Max ECU" during the Power Skating Max test. Signal connections between the integrated multi-purpose electronic block 9 (ECB) are depicted in FIG. 17.

During the Power Skating Max test, by means of a frequency converter 13, the electronic control block 9 (ECB) of the skatemill controls the speed of the skatemill belt 2 so that it could move at required speeds. The ECB also controls measuring and recording of data on values of the tensile or compressive force exerted by skaters or hockey players during the test in order to determine a skater's or a hockey player's speed performance profile, as described in Example 7 and then to continually (within one test) determine the endurance performance profile and fatigue index of a skater or a hockey player, as described in Example 8.

Example 10—$VO_{2max}$ on Skatemill

The integrated multi-purpose hockey skatemill with a system for the individual training and testing of the skating and hockey skills, as described in Example 1, can be used in a similar way to the previous example in combination with the electronic block "$VO_{2max}$ on Skatemill ECU" of the electronic control unit 9 (ECU). It can be used for automated management of the movement of the skatemill belt 2 during the $VO_{2max}$ on Skatemill test on the integrated multi-purpose hockey skatemill. FIG. 26 depicts a method for controlling the integrated multi-purpose hockey skatemill by the electronic control block 9 (ECB) equipped with the "$VO_{2max}$ on Skatemill ECU" during the $VO_{2max}$ on Skatemill test. Signal connections between the integrated multi-purpose electronic block 9 (ECB) are depicted in FIG. 17.

During the $VO_{2max}$ on Skatemill test, by means of a frequency converter 13, the electronic control block 9 (ECB) of the skatemill controls the movement of the skatemill belt 2 either in autonomous or coupled mode in order to determine an aerobic performance profile by an external spirometric or cardiopulmonary monitor. The external spirometric or cardiopulmonary monitor is connected to the universal communication interface of the electronic control block 9 (ECB) of the skatemill via own signal or data cable. Connection between the external spirometric or cardiopulmonary monitor and the electronic control block 9 (ECB) is not included in the technical solution of the skatemill.

When in the autonomous mode of the $VO_{2max}$ on Skatemill test, the electronic control block 9 (ECB) controls the movement of the skatemill belt 2 through a frequency converter 13 in such a way that it starts to move at a speed "$v_{START}$" and then it incrementally increases the speed of the skatemill belt in the I. speed zone by a 2 km/h stride until it reaches II. speed zone. Once in the II. speed zone, the speed incrementally increases each minute by a 1 km/h stride until the end of the test. The test itself finishes either after 1 minute of the maximum speed of the skatemill belt "$v_{skateMAX}$" or in any given moment on request of the skater or hockey player. After taking the test, the electronic control block 9 (ECB) of the skatemill stops the movement of the skatemill belt 2.

In both cases, the result of the test is a data set on aerobic performance profile recorded by an external spirometric or cardiopulmonary monitor.

Example 11

This example of a particular implementation of the technical solution describes a "not shown" variant design solution for the integrated multi-purpose hockey skatemill with a system for the individual training and testing of the skating and hockey skills in a modification meant for a hockey training center in the enclosed FIG. 1 whose basic features are sufficiently described in Example 1. The difference in design is that instead of the electronic control block 9 (ECB), a distinct electronic computing system, a computer equipped to perform the same control, logic and computing functions as those carried out by the electronic control block 9 (ECB), as described in Example 1.

Another "not shown" example of the technical solution that is described sufficiently in basic features in Example 1 is the use of multiple electronic computing systems, computers used to perform the same control, logic and computing functions as those carried out by the electronic control block 9 (ECB), as described in Example 1.

Example 12

Figure 15:
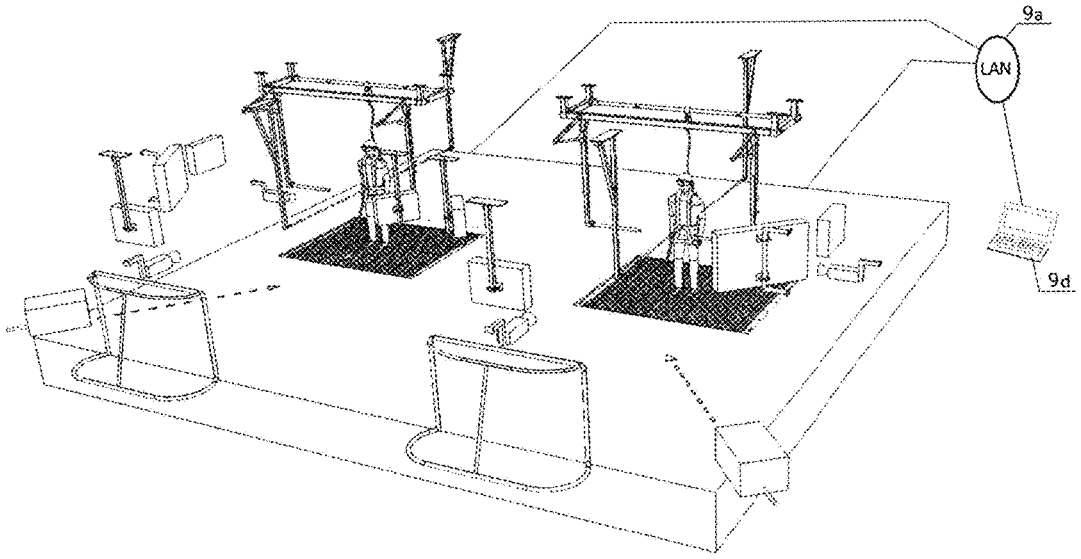
FIG. 15 represents a complete view of the arrangement of two integrated multi-purpose hockey skatemills where the both skatemill belts share one common stationary area of the artificial ice but where each skatemill has its own group of signalization/display elements.

This example of a particular implementation of the technical solution describes a variant design solution for the integrated multi-purpose hockey skatemill with a system for the individual training and testing of the skating and hockey skills in a modification meant for a hockey training center whose basic features are sufficiently described in Example 1 and shown in the FIG. 15. The difference in design is that this time both movable skatemill belts 2 share one common pair of puck feeders 7. At the same time they share one common stationary area of the artificial ice 1, only that each of the moving skatemill belts 2 has its own group of the signalization/display elements 5, its own group of the digital optical scanning cameras 6 as well as its own group of the tensile/compressive force sensors 8.

Figure 16:
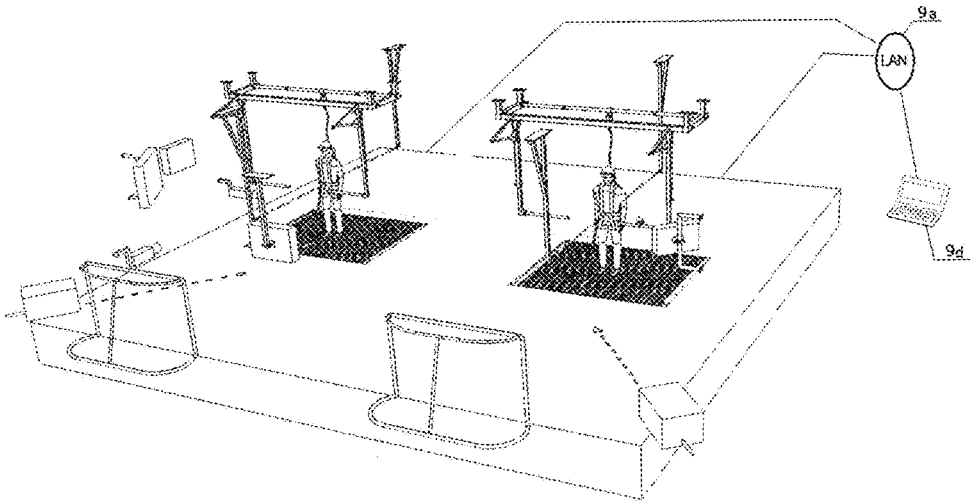
FIG. 16 represents an overview of the layout of two integrated multi-purpose hockey skatemills where the both skatemill belts share one common stationary area of the artificial ice and one common group of signalization/display elements.

Alternatively, the FIG. 16 depicts a solution where the two movable skatemill belts 2 share one common pair of puck feeders 7 and one common stationary area of the artificial ice 1. Both of the movable skatemill belts 2 also share a common group of signalization/display elements 5, but only one of the movable skatemill belts 2 is equipped with the digital optical scanning cameras 6. Another "not shown" example of the technical solution, in comparison with the solution depicted in the FIG. 16, is in a modification where only one movable skatemill belt 2 is equipped with the tensile/compressive force sensors 8.

INDUSTRIAL APPLICATION

The invention is intended especially for the individual training and testing of hockey players and other athletes who perform their activities on ice and use skates.

The invention claimed is:

1. An integrated multi-purpose hockey skatemill with a movable skatemill belt comprising:

a stationary area of the an artificial ice (1) wherein at least one of the movable skatemill belts (2) is built in by means of barrier-free transition areas and wherein the said skatemill belt comprises drive, protection and control elements connected to an electronic control block (9) ECB, which is built around with immovable artificial ice surface (1); wherein the said movable skatemill belt (2) is slidably mounted on a stationary sliding surface (2*b*) of a solid metal beams (2*a*) whose longer dimension is oriented in the direction of sliding movement of the movable skatemill belt (2); and wherein a safety restraint system (3) is anchored above the movable skatemill belt (2).

2. The integrated multi-purpose hockey skatemill with a movable skatemill belt as set forth in claim 1, including a stabilization system (4) anchored above the movable skatemill belt (2).

3. The integrated multi-purpose hockey skatemill with a movable skatemill belt as set forth in claim 1, including two laser markers (12) located in front of the movable skatemill belt (2) used to define the width of a skate track.

4. The integrated multi-purpose hockey skatemill with a movable skatemill belt as set forth in claim 1, including a hockey goal structure (11) located in a longitudinal axis of the movable skatemill belt (2) on a border line defining a frontal side of the stationary area of the artificial ice (1).

5. The integrated multi-purpose hockey skatemill with a movable skatemill belt as set forth in claim 1, including spaced elements (5) of a signalization/display system hung on a tiltable and sliding brackets (5*a*) at a frontal and lateral sectors with respect to the center of the movable skatemill belt (2).

6. The integrated multi-purpose hockey skatemill with a movable skatemill belt as set forth in claim 1, including spaced digital optical scanning cameras (6) on solid brackets (6*a*) located at edges of the stationary area of the artificial ice (1) in a longitudinal axis of the movable skatemill belt (2).

7. The integrated multi-purpose hockey skatemill with a movable skatemill belt as set forth in claim 1, including a tensile/compressive force measuring system placed on a front and back top-hung tiltable and sliding brackets (8*a*) in combination with two force sensors (8) and fiber and/or solid rods (8*b*).

8. The integrated multi-purpose hockey skatemill with a movable skatemill belt as set forth in claim 1, including an electronic control block (9) ECB connected with an acoustic sensor (11*b*) to monitor a hockey player's verbal messages that is fitted on a head mount holder as well as with target zones puck impact detection sensors (11*a*) placed on a hockey goal structure (11).

9. The integrated multi-purpose hockey skatemill with a movable skatemill belt as set forth in claim 1, including one or two puck feeders (7) located on a border line defining a front side of the stationary area of the artificial ice (1).

10. The integrated multi-purpose hockey skatemill with a movable skatemill belt as set forth in claim 1, including an electronic control block (9) ECB wherein the said block comprises at least one of the control blocks intended for automated management of trainings and tests:

a control block "LightShot ECU" to implement a management method for goal shooting training;

a control block "LightWatch ECU" to implement a management method for goal shooting training with peripheral vision;

a control block "Exercise Pattern ECU" to implement a Demo video and training method;

a control block "LiveView ECU" to implement a method for recording a training and playing a video footage of the training;

a control block "Skating Position ECU" to implement a method for recording a training and editing a video footage of the training;

a control block "Skating Power ECU" to implement a skater's speed performance profile method;

a control block "Power Skating Analysis ECU" to implement an endurance performance profile method;

a control block "Power Skating Max ECU" to implement a skater's endurance performance profile and fatigue index method;

a control block "$VO_{2max}$ on Skatemill ECU" to implement an aerobic performance profile assessment method.

11. The integrated multi-purpose hockey skatemill with a movable skatemill belt as set forth in claim 10, including the electronic control block (9) ECB wherein the said block is an electronic computing system.

* * * * *